US007990347B2

(12) United States Patent
Numao

(10) Patent No.: US 7,990,347 B2
(45) Date of Patent: Aug. 2, 2011

(54) DISPLAY DEVICE

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 958 days.

(21) Appl. No.: 11/918,652

(22) PCT Filed: Jul. 7, 2006

(86) PCT No.: PCT/JP2006/313591

§ 371 (c)(1),
(2), (4) Date: Oct. 17, 2007

(87) PCT Pub. No.: WO2007/018006

PCT Pub. Date: Feb. 15, 2007

(65) Prior Publication Data

US 2009/0073092 A1 Mar. 19, 2009

(30) Foreign Application Priority Data

Aug. 5, 2005 (JP) ..... 2005-228574

(51) Int. Cl.
*G09G 3/30* (2006.01)

(52) U.S. Cl. ..... 345/76

(58) Field of Classification Search ..... 345/76–84, 345/211; 315/169.3–169.4
See application file for complete search history.

(56) References Cited

U.S. PATENT DOCUMENTS

| | | | |
|---|---|---|---|
| 2004/0046164 | A1 | 3/2004 | Kobayashi et al. |
| 2004/0174354 | A1 | 9/2004 | Ono et al. |
| 2006/0061293 | A1 | 3/2006 | Kobayashi et al. |
| 2006/0077134 | A1 | 4/2006 | Hector et al. |

FOREIGN PATENT DOCUMENTS

| | | |
|---|---|---|
| EP | 1590787 | 11/2005 |
| JP | 2005-352398 | 12/2005 |
| JP | 2006-516745 | 7/2006 |
| WO | WO 98/48403 | 10/1998 |
| WO | WO 2004/066249 | 8/2004 |

OTHER PUBLICATIONS

S. Ono et al. "Pixel Circuit for a-Si AM-OLED" IDW '03 pp. 255-258.

*Primary Examiner* — Alexander Eisen
*Assistant Examiner* — Robin Mishler
(74) *Attorney, Agent, or Firm* — Harness, Dickey & Pierce, P.L.C.

(57) ABSTRACT

In one embodiment, a display device of the present invention includes capacitors provided between a gate and a source of a driver TFT. During a select period, a voltage is fed to the gate terminal of the driver TFT, and a voltage is fed to the source terminal of the driver TFT. Thereafter, during a threshold correction period, the gate voltage of the driver TFT is retained to make the source voltage of the driver TFT equal to Vda−Vth (<Vcom). Subsequently, the gate voltage of the driver TFT is changed to control a current flowing between the drain and the source of the driver TFT.

8 Claims, 18 Drawing Sheets

DISPLAY DEVICE

TECHNICAL FIELD

The present invention relates to display devices using an electro-optical element such as organic EL (electro luminescence) (Organic Light Emitting Diodes) or EP (Electronic Paper).

BACKGROUND ART

Recently, research and development have been actively conducted on a display device using an electro-optical element such as organic EL or EP. Particularly, the organic EL display is the focus of attention in view of possible applications in mobile phones, PDAs Personal Digital Assistants), and like mobile devices, to exploit its low voltage/low power consumption.

FIG. 14 illustrates a pixel circuit disclosed in Patent document 1, as the structure of an organic EL display drive circuit.

A pixel circuit 300 illustrated FIG. 14 includes four p-type TFTs (Thin Film Transistors) 360, 365, 370, 375, two capacitors 350, 355, and an OLED (organic EL) 380. The TFTs 365 and 375 and the organic EL (OLED) 380 are connected in series between a power supply line 390 and a common cathode (GND). The capacitor 350 and the switching TFT 360 are connected in series between a gate terminal of the driver TFT 365 and a data line 310. The switching TFT 370 is present between the gate terminal and a drain terminal of the driver TFT 365. The capacitor 355 is present between the gate terminal and a source terminal of the driver TFT 365. The gate terminals of the TFTs 360, 370, 375 are connected respectively to a select line 320, an auto-zero line 330, and a lighting line 340.

In this pixel circuit 300, the auto-zero line 330 and the lighting line 340 go GL (LOW) during the first period. This turns on the switching TFTs 370, 375, placing the drain terminal and gate terminal of the driver TFT 365 at the same potential. The driver TFT 365 is therefore turned on, allowing a current flow from the driver TFT 365 to the OLED 380.

At this moment, the data line 310 is fed with reference voltage, and the select line 320 is set to GL which in turn keeps at reference voltage one of terminals of the capacitor 350 that connects to the TFT 360.

During the second period, the lighting line 340 is set to GH(HIGH), turning off the TFT 375.

The gate voltage of the driver TFT 365 then gradually increases. As the gate voltage reaches a value (VDD+Vth) corresponding to the threshold voltage Vth of the driver TFT 365 (Vth<0), the driver TFT 365 is turned off.

During the third period, the auto-zero line 330 is set to GH, turning off the switching TFT 370. Thus, the capacitor 350 holds the difference between its gate voltage and the reference voltage.

In other words, the gate voltage of the driver TFT 365 is equal to a value VDD+Vth corresponding to the threshold voltage Vth when the reference voltage is on the data line 310. If the voltage on the data line 310 changes from the reference voltage, a current in accordance with the change needs to flow through the driver TFT 365, regardless of the threshold voltage of the driver TFT 365.

To this end, the voltage on the data line 310 is changed by that desired amount. The select line is set to HIGH, turning off the switching TFT 360. The capacitor 355 maintains the gate voltage of the driver TFT 365. This ends a select period for the pixel.

Thus, the use of the pixel circuit illustrated in FIG. 14 allows for compensation for variations of the threshold voltage Vth of the driver TFT 365, and supply of the voltage (desired potential-threshold potential) obtained by the compensation to the gate terminal of the driver TFT 365.

However, the pixel circuit illustrated in FIG. 14 causes voltage drop at the switching TFT 375, which increases power consumption. This is because the driver TFT 365, the switching TFT 375, the organic EL OLED are connected in series between the power supply line 390 and the common cathode (GND).

For the reduction of the voltage drop, it is effective to increase a gate width of the switching TFT 375.

This increases a gate size of the switching TFT 375 and decreases an aperture ratio in a bottom emission structure (structure in which light is taken from the TFT substrate side).

Further, higher definition is difficult to achieve in a top emission structure (structure in which light is taken from the side opposite to the TFT substrate side).

Especially, this problem becomes more pronounced in fabricating TFTs with low-mobility amorphous Si.

In view of this, Non-patent document 1 discloses the arrangement in which a driver TFT and an organic EL are directly coupled between a power supply line and a common electrode, but no switching TFT is disposed therebetween. A pixel circuit illustrated in FIG. 15 is the pixel circuit disclosed in Non-patent document 1.

The pixel circuit illustrated in FIG. 15 is composed of four n-type TFTs T1 through T4, a capacitor Cs, and an organic EL OLED. The organic EL OLED and the driver TFT T4 are directly connected in series between a common electrode GND and a power supply line COM. The switching TFT T3 is disposed between a gate terminal a and a drain terminal c of the driver TFT T4. The capacitor Cs and the switching TFT T1 are disposed in series between the gate terminal of the driver TFT T4 and a data line DAT. The switching TFT T2 is disposed between the power supply line COM and a node b of the capacitor Cs and the switching TFT T1.

Control lines SCT, MRG, RST are connected to the switching TFTs T1 through T3, respectively.

FIG. 16 illustrates operations of the power supply line COM and the control lines MRG, RST, SCT.

In the pixel circuit in FIG. 15, the power supply line COM is first fed with a voltage Vp. Since a voltage of the gate terminal a of the driver TFT T4 is higher than that of a terminal c of the driver TFT T4, the driver TFT T4 is turned on and a current is flown from the power supply line COM to the organic EL OLED. As a result of this, the voltage of the terminal c takes a positive value and a reverse voltage is applied to the organic EL OLED.

Then, the control line RST is set to GH, turning on the switching TFT T3. With this, the voltage of the gate terminal a of the driver TFT T4 becomes equal to the voltage of the terminal c (i.e. voltage of the power supply line COM>voltage of the terminal c), which turns off the driver TFT T4. At this moment, voltage Vg (with reference to anode voltage GND of the OLED) of the gate terminal a is required to be higher than threshold voltage Vth of the driver TFT T4.

Next, a voltage of the power supply line COM is set to 0V. At this moment, voltages of the gate terminal a and the terminal c are higher than the threshold voltage Vth of the driver TFT T4. This flows a current from the gate terminal a to the power supply line COM, and a difference in voltage between the gate terminal a and the power supply line COM becomes voltage Vth. A difference in voltage between the one end of the capacitor Cs and the other thereof becomes Vth.

Next, the control line MRG is set to GL to turn off the switching TFT T2, while the control line SCT is set to GH to turn on the switching TFT T1. Then, the terminal b is fed with required voltage Vda from the data line DAT.

At this moment, since a reverse voltage is applied to the organic EL OLED, the organic EL OLED serves as a capacitor. This causes the terminal a to be varied in voltage according to the variation of the voltage of the terminal b.

That is, when Co is capacitance of the organic EL OLED and Cs is capacitance of the capacitor Cs, $$(Vth-0)+(Vth-0)=(Vx-Vda)Cs+(Vx-0)Co$$

$$\therefore Vth(Cs+Co)+Vda\cdot Cs=Vx(Cs+Co)$$

$$\therefore Vx=Vth+Vda\cdot Cs/(Cs+Co)$$

Further, difference between the voltage of the gate terminal a of the driver TFT T4 and the voltage of the terminal b is expressed by the following equation:

$$Vx-Vda=Vth+Vda\cdot Cs/(Cs+Co)-Vda=Vth-Vda\cdot Co/(Cs+Co)$$

Then, the control line SCT is set to GL to turn off the switching TFT T1, so that the voltage of the gate terminal a is held.

Thereafter, the control line RST is set to GL to turn off the switching TFT T3, and the control line MRG is set to GH to turn off the switching TFT T2.

Further, a voltage of the power supply line COM is set to −VDD.

As a result of this, gate-to-source voltage Vgs of the driver TFT T4 (voltage between the terminal a and the power supply line COM) is kept Vx−Vda.

That is, when Vda<0, the driver TFT T4 is turned on. When Vda≧0 the driver TFT T4 is turned off.

Whether the driver TFT T4 is turned on or off, the voltage of the drain terminal c is higher than the voltage of the source terminal (power supply line COM). When Vda<0, and drain-to-source voltage Vds of the driver TFT T4 is higher than gate-to-source voltage Vgs of the driver TFT T4, a current corresponding to Vgs is flown from the drain terminal of the driver TFT T4 to the source terminal thereof. Then, the current is supplied from the GND through the organic EL OLED.

Thus, the use of the pixel circuit illustrated in FIG. 15 in which the organic EL OLED and the driver TFT T4 are directly connected between the common electrode GND and the power supply line COM enables compensation for variation in threshold voltage of the driver TFT T4 and supply of a desired current to the organic EL OLED.

FIG. 17 illustrates the structure of the pixel circuit disclosed in Patent document 2.

As illustrated in FIG. 17, in this pixel circuit, a driver TFT 106 and an organic EL 107 are directly connected between a GND line and a power supply line 109. A switching TFT 108 is disposed between a gate and a drain of the driver TFT 106 (Herein, GND line side of the driver TFT 106 is a drain terminal). Switching TFTs 111 and 104 are disposed in series in this order between the gate terminal of the driver TFT 106 and the data line 103. A capacitor 105 is disposed between the source terminal of the driver TFT 106 and a node of the switching TFT 111 and the switching TFT 104. A scanning line 112 is connected to the respective gate terminals of the switching TFTs 108 and 111, and a scanning line 110 is connected to a gate terminal of the switching TFT 104.

Note that the TFTs 104, 106, 111 are n-type TFTs, and the TFT 108 is a p-type TFT.

The operation of the pixel circuit illustrated in FIG. 17 can be described with reference to FIGS. 18(*a*) through 18(*d*).

That is, as illustrated in FIG. 18(*a*), to begin with, the scanning line 110 is set to a negative voltage to turn off the switching TFT 104, while the scanning line 112 is set to a positive voltage to turn off the switching TFT 108 and turn on the switching TFT 111. Then, a negative voltage of a power supply line 109 is changed to a positive voltage. At this moment, the organic EL 107 operates as a capacitor (because the organic EL 107 is fed with a reverse voltage). According to difference in voltage between the organic EL 107 and the capacitor 105, a gate terminal of the driver TFT 106 becomes a positive voltage, and the driver TFT 106 is turned on. This allows electric charge to flow from the anode terminal of the organic EL 107 to the GND line. Then, the voltage of the source terminal of the driver TFT 106 approaches GND voltage, and the driver TFT 106 is turned off.

Next, as illustrated in FIG. 18(*b*), the scanning line 112 is set to negative voltage to turn off the switching TFT 111 and turn on the switching TFT 108. This allows the gate terminal of the driver TFT 106 to have GND voltage.

Subsequently, by changing positive voltage of the power supply line 109 to GND voltage, the source terminal of the driver TFT 106 becomes highly negative voltage. This allows a gate-to-source voltage of the driver TFT 106 to be positive voltage, which turns on the driver TFT 106. Then, electric charge is supplied from the drain terminal to the source terminal of the driver TFT 106, which turns a gate-to-source voltage of the driver TFT 106 to threshold voltage −Vth. This turns off the driver TFT 106.

By the way, at the time when the switching TFT 111 is turned off, a voltage of the scanning line 110 is set to positive voltage to turn on the switching TFT 104. As illustrated in FIG. 18(*c*), voltage Vd1 corresponding to luminance of the organic EL 107 is fed from the data line 103 to a terminal (other terminal) of the capacitor 105 on the switching TFT 104 side.

As a result of this, GND voltage is fed to the gate terminal of the driver TFT 106, a voltage of the source terminal of the driver TFT 106 becomes −Vth, and voltage Vd1 is fed to the other terminal of the capacitor 105.

Then, as illustrated in FIG. 18(*d*), after the scanning line 110 is set to negative voltage to turn off the switching TFT 104, the scanning line 112 is set to positive voltage to turn off the switching TFT 108 and turn on the switching TFT 111.

As a result of this, a gate-to-source voltage of the driver TFT 106 turns Vd1+Vth. Thus, it is possible to control the driver TFT 106 to flow a current corresponding to voltage Vd1 regardless of the threshold voltage Vth of the driver TFT 106.

[Patent document 1]

Japanese PCT National Phase Unexamined Patent Publication No. 514320/2002 (published on May 14, 2002)

[Patent document 2]

Japanese PCT National Phase Unexamined Patent Publication No. 280059/2004 (published on Oct. 7, 2004)

[Non-patent document 1]

IDW '03, pp. 255-258 (held on Dec. 3 to 5, 2003).

DISCLOSURE OF INVENTION

However, the pixel circuit illustrated in FIG. 15 requires change of a voltage of the power supply line COM. On this account, it is necessary to provide switches between the power supply line COM and a voltage source Vp, between the power supply line COM and GND, and between the power supply line COM and −VDD.

Assume that display is performed in portrait (vertical) orientation on a display device with pixels whose number is QVGA. In this case, 240 pixels are connected to each power supply line COM. White emission of all the corresponding organic ELs OLED disposed on the pixels requires a current of approximately 2 μA for each pixel and requires 0.48 mA for each power supply line COM.

In order to supply such a current by using a switch, it is difficult to make a switch from CG silicon TFT and polysilicon TFT.

For this reason, an external IC is required to make up a switch.

Further, even when a driver circuit is fabricated with ICs, like amorphous silicon TFT, a size of the switching TFT increases. Area of the switching TFT increases accordingly. This results in increase in cost of the IC.

Also, the pixel circuit illustrated in FIG. 17 changes a voltage of the common line 109. This requires a switch to be disposed between the common line 109 and the power source.

The present invention has been attained in view of the above problem, and an object of the present invention is to realize a display device which eliminates the need for a switch between the power supply line and the voltage source and reduces a production cost with the arrangement such that the driver transistor and the electro-optical element are directly connected between the power supply line and the common electrode so that the compensation for the threshold of the driver transistor can be made without changing the voltage of the power supply line.

In order to solve the above problem, the display device according to the present invention is a display device in which a driver transistor and an electro-optical element are directly connected between a power supply line and a common electrode, and a current corresponding to an image signal is fed to the electro-optical element so that a corresponding image is displayed thereon, wherein a node B is a node of the driver transistor and the electro-optical element, Vcom is a voltage of a terminal opposite the node B out of two terminals of the electro-optical element, and Vth is a threshold voltage of the driver transistor, the display device comprising: an initialization section that performs initialization in which while Vcom is kept constant, a voltage Vs of the node B is set to be lower than Vcom if the node B is coupled to an anode of the electro-optical element, and the voltage Vs of the node B is set to be higher than Vcom if the node B is coupled to a cathode of the electro-optical element; a threshold correcting section that performs threshold correction in which a voltage for threshold correction is applied to a gate of the driver transistor under the condition where the initialization is performed, so that the gate-to-source voltage Vgs of the driver transistor is changed to Vth; and a signal control section that performs signal control in which a voltage for signal control is applied to the gate of the driver transistor under the condition where the threshold correction is performed, so that the gate-to-source voltage Vgs is changed to a value represented by a sum of the threshold voltage Vth and a value of a voltage corresponding to an image signal.

According to the above arrangement, the voltage Vs of the node B is set as described above. The voltage Vs is set so that when the voltage for threshold correction is applied to the gate of the driver transistor, the gate-to-source voltage Vgs of the driver transistor becomes higher than a maximum value of Vth. The voltage for threshold correction is set to be lower (or higher) than Vcom+minimum value of Vth. More specifically, in the case where the driver transistor is an n-type transistor, the voltage for threshold correction is set to be lower than Vcom+minimum value of Vth. On the other hand, in the case where the driver transistor is a p-type transistor, the voltage for threshold correction is set to be higher than Vcom+minimum value of Vth. With this arrangement, the gate-to-source voltage Vgs of the driver transistor can be set to the threshold voltage Vth while the amount of current flown to the electro-optical element is suppressed. Under such a situation, Vgs is changed to a value represented by a sum of Vth and a voltage value corresponding to an image signal (e.g. Va−Vda), whereby the value Ids of the current flowing to the electro-optical element is controlled regardless of Vth. This brings the effect such that the compensation for the threshold of the driver transistor can be made without changing the voltage of the power supply line, and the need for a switch between the power supply line and the voltage source is eliminated, so that reduction in production cost of the display device can be realized.

Further, it is possible to obtain the effect such that the compensation for the threshold of the driver transistor can be ensured regardless of a select period.

In order to solve the above problem, the display device according to the present invention is a display device in which a driver transistor and an electro-optical element are directly connected between a power supply line and a common electrode, and a current corresponding to an image signal is fed to the electro-optical element so that a corresponding image is displayed thereon, wherein a first capacitor and a second capacitor are connected in series in this order between a gate terminal of the driver transistor and a node B, which is a node of the driver transistor and the electro-optical element, a first switching transistor is provided between the gate terminal of the driver transistor and the first line, and a second switching transistor is provided between a second line and a node A, which is a node of the first capacitor and the second capacitor.

According to the above arrangement, the threshold voltage Vth or a voltage corresponding to the threshold voltage Vth is retained by one of the first capacitor and the second capacitor, and a voltage retained by the other capacitor is changed. This makes it possible to control the gate-to-source voltage Vgs of the driver transistor so that the driver transistor feeds a current of a desired value. As a result of this, a current of a desired value can be flown from the driver transistor to the electro-optical element, regardless of the threshold voltage Vth of the driver transistor. This brings the effect such that the compensation for the threshold of the driver transistor can be made without changing the voltage of the power supply line, and the need for a switch between the power supply line and the voltage source is eliminated, so that reduction in production cost of the display device can be realized.

Further, it is possible to obtain the effect such that the compensation for the threshold of the driver transistor can be ensured regardless of a select period.

Still further, the above arrangement brings the effect such that a current flowing to the electro-optical element can be controlled with a simple arrangement.

Additional objects, features, and strengths of the present invention will be made clear by the description below. Further, the advantages of the present invention will be evident from the following explanation in reference to the drawings.

EXPLANATION OF REFERENCE NUMERALS

Figure 1:
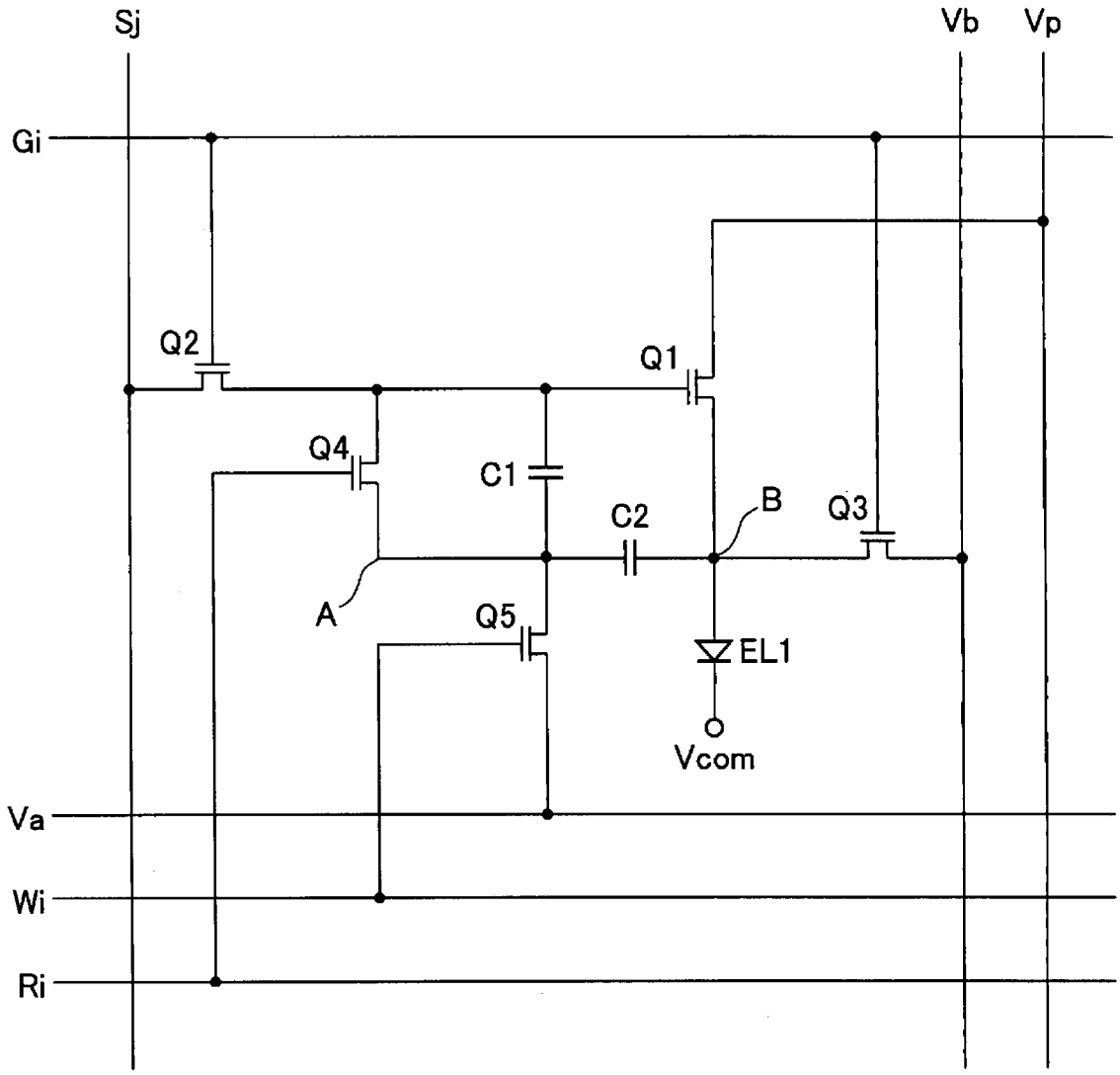
FIG. 1 is a circuit diagram illustrating the structure of a pixel circuit used in First Embodiment.

1 Display device
2 Pixel matrix
3 Source driver circuit
4 Gate driver circuit
6 m-bit shift register
6 m×6-bit shift register
7 m×6-bit latch
8 D/A converter
9 n-bit shift register
10 Logical circuit
Aij Pixel circuit
Sj Source line
Gi Gate line
Ri, Wi Control lines
Va, Vb, Ui Voltage lines
Vp Power supply line

BEST MODE FOR CARRYING OUT THE INVENTION

The following will describe details of the present invention with Embodiments and Comparative Embodiments. However, an embodiment of the present invention is not limited to the above Embodiments and Comparative Embodiments.

The embodiment of the present invention is described below with reference to FIGS. 1 through 13.

A switching element used in the present invention can be made of a low temperature polysilicon TFT or a CG (continuous grain) silicon TFT. The structures of these TFTs and their manufacturing process are publicly known; no detailed description will be given here.

Further, the structure of an organic EL element that is an electro-optical element used in the present embodiment is also publicly known; no detailed description will be given here.

(Basic Structure of Pixel Circuit)

A display device of the present invention is such that a driver transistor (Q1) and an electro-optical element (EL1) are directly connected between a power supply line and a common electrode, and the driver transistors (Q1) and electro-optical elements (EL1) are arranged in a matrix manner, wherein a first capacitor (C1) and a second capacitor (C2) are connected in series in this order between a gate terminal of the driver transistor (Q1) and a node B of the driver transistor (Q1) and the electro-optical element (EL1), a first switching transistor (Q2) is provided between the gate terminal of the driver transistor (Q1) and a first line (source line Sj or voltage line Va), and a second switching transistor (Q5) is provided between a second line (voltage line Va or source line sj) and a node A of the first capacitor (C1) and the second capacitor (C2).

Note that out of two terminals of the electro-optical element (EL1), a terminal opposite the node B has a voltage Vcom, and a threshold voltage of the driver transistor (Q1) is Vth (Vth takes positive value if the driver transistor (Q1) is n-type transistor, whereas Vth takes negative value if the driver transistor (Q1) is a p-type transistor).

The source line Sj applies to the gate terminal of the driver transistor (Q1) a desired voltage, i.e. a voltage corresponding to data voltage Vda as an image signal. The voltage line Va or Ui described later supplies a predetermined auxiliary voltage Va to the node A.

At this moment, when the node B is coupled to an anode of the electro-optical element (EL1), voltage Vs of the node B is set to be lower than Vcom. To be more precise, the voltage Vs of the node B is set so that a gate-to-source voltage Vgs of the driver transistor is higher than a maximum value of Vth under the condition where a minimum voltage is applied to the gate terminal of the driver transistor. In addition, the voltage of the node B is set to be lower than Vcom even when the gate-to-source voltage Vgs of the driver transistor becomes a maximum value of Vth under the condition where a maximum voltage is applied to the gate terminal of the driver transistor. On the other hand, when the node B is coupled to a cathode of the electro-optical element (EL1), the voltage Vs thereof is set to be higher than Vcom. To be more precise, the voltage Vs of the node B is set so that the gate-to-source voltage Vgs of the driver transistor is higher than a maximum value of Vth under the condition where a maximum voltage is applied to the gate terminal of the driver transistor. In addition, the voltage of the node B is set to be higher than Vcom even when the gate-to-source voltage Vgs of the driver transistor becomes a minimum value of Vth under the condition where a minimum voltage is applied to the gate terminal of the driver transistor. In the case of amorphous Si, Vth normally increases due to the deterioration with use. In view of this, the voltage Vs should be sufficiently lower (higher) than Vcom. For example, Vth whose initial value is 2V gets higher to 5V, 10V, or other value with use. If the voltage of the node B is only set to be lower than Vcom−2V when Vth is an initial value, Vth will be 5V, 10V, or other value, for which compensation is impossible. On this account, considering a value of Vth after deterioration, the voltage of the node B is should be set to be lower (or higher) than (Vcom−Vth after deterioration). Hereinafter, in the descriptions concerning the settings of a voltage of the node B and any values, the expression "sufficiently higher (lower)" relative to threshold voltage Vth means the same as in the above case.

In the above arrangement, by changing the voltage Vs of the node B and applying a reverse voltage to the electro-optical element (EL1), a value of a current that flows through the electro-optical element (EL1) can be set to almost zero.

Further, it is preferable that a voltage Vg fed from the first line (source line Sj or voltage line Va) to the gate terminal of the driver transistor (Q1) is close to the voltage Vcom.

At this time, if the node B is a reference voltage terminal (source terminal) of the driver transistor (Q1), the gate-to-source voltage Vgs of the driver transistor (Q1) becomes threshold voltage Vth after threshold compensation period.

This makes it possible to correct a threshold value of the driver transistor (Q1) without providing a switching transistor between the driver transistor (Q1) and the electro-optical element (E1).

Moreover, it is unnecessary to change voltages of the power supply line and the common electrode. This eliminates the need for a switch between the power supply line and a voltage source. Further, it is possible to take a sufficient time for the threshold compensation.

Then, one of the first capacitor (C1) and the second capacitor (C2) is caused to retain the threshold voltage Vth (or voltage corresponding to the threshold voltage Vth), and the other capacitor is caused to change the voltage that it retains.

This makes it possible to control the gate-to-source voltage Vgs of the driver transistor (Q1) so that the driver transistor (Q1) feeds a current of a desired value.

As a result of this, regardless of the threshold voltage Vth of the driver transistor (Q1), a value of a current flowing from the driver transistor (Q1) to the electro-optical element (EL1) can be made to have a desired value.

As described above, with the use of the display device of the present invention, the threshold voltage Vth of the driver transistor is corrected and a current flow from the driver transistor to the electro-optical element can be controlled, by using the pixel circuit arrangement in which the driver transistor and the electro-optical element are connected in series between the power supply line and the common electrode without provision of a switching transistor therebetween.

Thus, since the use of means of the present invention eliminates a switching transistor between the driver transistor and the electro-optical element, it is possible to avoid increase of power consumption caused by voltage drop in the switching transistor.

Especially, to realize the switching transistor by amorphous silicon, a size of the switching transistor increases. The display device of the present invention eliminates the need for such a switching transistor, thereby enabling a high aperture ratio in the bottom emission structure and a high definition in the top emission structure.

Further, it is not necessary to adjust voltages of the power supply line and the common electrode. This eliminates the need for a switch for adjusting the voltages thereof.

Thus, a substrate made from CG silicon TFT or polysilicon TFT eliminates the need for an external switch. This makes it possible to fabricate the driver circuit from CG silicon or polysilicon TFT, thus enabling cost reduction of the display device.

Further, a substrate made from amorphous silicon TFT eliminates the need for such a switch in a driver IC. Production of the display device is realized at a low cost.

Thus, the use of the means of the present invention evidently brings advantageous effects.

In the above arrangement, as methods for obtaining a voltage fed to the gate terminal of the driver transistor (Q1), the following methods are considered: "first driving method" in which the voltage is obtained from the source line Sj; and "second driving method" in which the voltage is obtained from the voltage line.

In the above arrangement, as an initialization arrangement for making the voltage Vs of the node B sufficiently lower than Vcom−Vth (or sufficiently higher than Vcom−Vth), the following two arrangements are considered: "first initialization arrangement" in which a third switching transistor (Q3) is disposed between the node B and the third line (voltage line Vb); and "second initialization arrangement" in which a voltage of the second line (voltage line Ui) is changed.

Further, in the above arrangement, as changing means for changing a voltage of the capacitor that does not hold the threshold voltage Vth, the following two means are considered: "first changing means" which is the fourth switching transistor (Q4) provided in parallel to the first capacitor (C1) or the second capacitor (C2); and "second changing means" which are the second switching transistor (Q1) disposed between the node A and the second line (source line Sj) and the third switching transistor (Q3) disposed between the node B and the third line (voltage line Vb).

The following will describe the "first driving method", "second driving method", "first initialization arrangement", "second initialization arrangement", "first changing means", and "second changing means".

(First Driving Method)

The first driving method performed in the above display device is a method in which during a first period data voltage (Vda) is applied as a desired voltage, i.e. an image signal from the first line (source line Sj) to the gate terminal of the driver transistor (Q1), a predetermined auxiliary voltage (Va) is applied from the second line (voltage line Va) to the node A, the voltage (Va) of the node A is maintained during the second period, and the voltage of the gate terminal of the driver transistor (Q1) is changed during a third period.

In the above driving method, a desired voltage Vda is fed from first line (source line Sj) to the gate terminal of the driver transistor (Q1) during the first period.

Throughout the first period and the second period, a predetermined voltage Va is fed from the second line (voltage line Va) to the node A via the second switching transistor (Q5).

This fixes a voltage of the other terminal (terminal of the node A) of the first capacitor (C1), and holds the desired voltage Vda fed to the gate terminal of the driver transistor (Q1).

During the first period, the voltage Vs of the node B is sufficiently lower than Vcom (or sufficiently higher than Vcom). At the end of the second period, the voltage of the node B is Vda−Vth and the gate-to-source voltage of the driver transistor (Q1) is threshold voltage Vth.

At this moment, voltage difference across the first capacitor (C1) is Vda-Va. Therefore, voltage difference across the second capacitor (C2) is a voltage (Vda−Vth)−Va corresponding to the threshold voltage Vth.

Thereafter, when the voltage difference across the first capacitor (C1) is made to take zero or a predetermined value, it is possible to control the gate-to-source voltage Vgs of the driver transistor (Q1) by the desired voltage Vda fed from the first line (source line Sj).

As a result of this, a value of a current flowing from the driver transistor (Q1) to the electro-optical element (EL1) is set to a desired value, regardless of the threshold voltage Vth of the driver transistor (Q1).

(Second Driving Method)

The second driving method performed in the above display device is a method in which during a first period a predetermined voltage (Va) is applied from the first line (voltage line Va) to the gate terminal of the driver transistor (Q1), a desired voltage (Vda) is applied from the second line (source line Sj) to the node A during a second period, and the voltage of the gate terminal of the driver transistor (Q1) is changed.

In the above driving method, a predetermined voltage Va is fed from a first line (voltage line Va) to the gate terminal of the driver transistor (Q1) during the first period.

With this, at the end of the first period, the voltage of the node B is Va−Vth.

In view of this, a voltage held by the second capacitor (C2) during the first period is set to a voltage V0. This makes it possible to make voltage difference across the first capacitor (C1) Vth−V0.

During the second period, the desired voltage Vda is applied from the second line (source line Sj) to the node A, so that the voltage held by the second capacitor (C2) is changed from V0 to a voltage obtained by the desired voltage Vda−Vb. Herein, Vb is a voltage of the third line.

With this, it is possible to control the gate-to-source voltage Vgs of the driver transistor (Q1) by the desired voltage Vda fed from the first line (source line Sj).

As a result of this, a value of a current flowing from the driver transistor (Q1) to the electro-optical element (EL1) is set to a desired value, regardless of the threshold voltage Vth of the driver transistor (Q1).

In the means of the present invention, as an initialization arrangement for making the voltage Vs of the node B sufficiently lower than Vcom (or sufficiently higher than Vcom), the following two arrangements are considered: "first initialization arrangement" in which the third switching transistor (Q3) is disposed between the node B and the third line (voltage line Vb); and "second initialization arrangement" in which a voltage of the second line (voltage line Ui) is changed.

(First Initialization Arrangement)

The first initialization arrangement is such that in the above-mentioned display device the third switching transistor (Q3) is disposed between the node B and the third line (voltage line Vb).

In the above arrangement, by turning on the third switching transistor (Q3), the voltage of the node B can be set to the voltage Vb of the third line (voltage line Vb).

In view of this, when the voltage Vb is set so as to be sufficiently lower than Vcom (or sufficiently higher than Vcom), the above objective can be achieved.

(Second Initialization Arrangement)

The second initialization arrangement is such that in the above-mentioned display device the voltage of the second line (voltage line Ui) is changed.

In the above arrangement, when the second switching transistor (Q5) is turned on, the voltage of the second line (voltage line Ui) is changed, and the voltage of the node A coupled to the second line (voltage line Ui) is changed. This makes it possible to change the voltage of the node B through the second capacitor (C2).

Then, the voltage of the second line (voltage line Ui) should be changed so that the voltage of the node B is sufficiently lower than Vcom (or sufficiently higher than Vcom).

Further, in the above arrangement, as changing means for changing a voltage of the capacitor that does not hold the threshold voltage Vth, the following two means are considered: "first changing means" in which the first capacitor (C1) or the second capacitor (C2) is disposed in tandem with the fourth switching transistor (Q4); and "second changing means" in which the second switching transistor (Q1) is disposed between the node A and the second line (source line Sj), and the third switching transistor (Q3) is disposed between the node B and the third line (voltage line Vb).

(First Changing Means)

The first changing means is such that in the above-mentioned display device, the first capacitor (C1) or the second capacitor (C2) is disposed in tandem with the fourth switching transistor (Q4).

According to the above arrangement, the voltage of the capacitor that holds (voltage corresponding to) the desired voltage Vda (capacitor that does not hold the threshold voltage Vth) can be set to zero. Then, by controlling the voltage Vda, it is possible to control the gate-to-source voltage Vgs of the driver transistor (Q1).

As a result of this, it is possible to control a current flowing from the driver transistor (Q1) to the electro-optical element (EL1).

Also, the voltage of the capacitor that holds the voltage V0 (capacitor that does not hold the threshold voltage Vth) can be set to (voltage corresponding to) the voltage Vda.

As a result of this, it is possible to control a current flowing from the driver transistor (Q1) to the electro-optical element (EL1).

(Second Changing Means)

The second changing means is such that in the above-mentioned display device, the second switching transistor (Q11) is disposed between the node A and the second line (source line Sj), and the third switching transistor (Q3) is disposed between the node B and the third line (voltage line Vb).

According to the above arrangement, the first switching transistor (Q12) disposed between the gate terminal of the driver transistor (Q1) and the first line (voltage line Va) is turned off, whereas the second switching transistor (Q11) disposed between the node A and the second line (source line Sj) is turned on, and the third switching transistor (Q3) disposed between the node B and the third line (voltage line Vb) is turned on.

As a result of this, the voltage Vda of the second line (source line Sj) can be fed to the node A, and the voltage Vb of the third line (voltage line Vb) can be fed to the node B, so that voltage difference across the second capacitor (C2) can be Vda−Vb. Then, by controlling the voltage Vda fed from the second line (source line Sj), it is possible to control the gate-to-source voltage Vgs of the driver transistor (Q1).

As a result of this, it is possible to control a current flowing from the driver transistor (Q1) to the electro-optical element (EL1).

The following will describe specific structure examples in which the foregoing arrangements are combined.

FIRST EMBODIMENT

In First Embodiment, a display device using the means of the present invention and adopting the first driving method, the first initialization arrangement, and the first changing means will be described.

Figure 2:
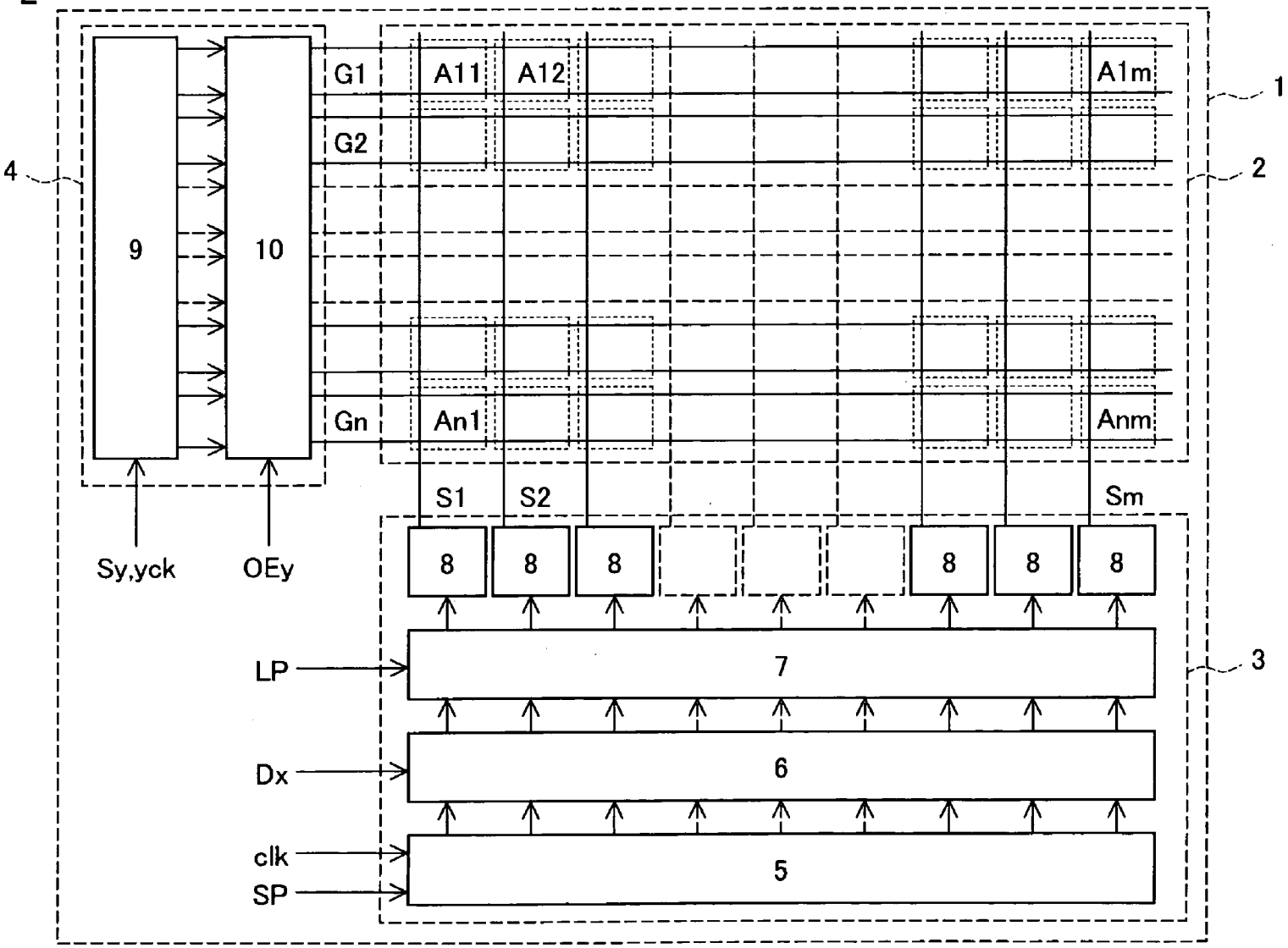
FIG. 2 is a block diagram illustrating the structure of a display device used in First through Third Embodiments.

As illustrated in FIG. 2, a display device 1 of the present embodiment has m-by-n pixel circuits Aij, a gate driver circuit 4, and a source driver circuit 3. The pixel circuits Aij are arranged in a matrix manner. The gate driver circuit 4 is means that controls control lines of the pixel circuit Aij. The source driver circuit 3 is means that controls source lines.

Pixel circuits Aij are disposed in a matrix manner and each of the pixel circuits Aij is located at an intersection of a source line Sj and a gate line Gi. The source driver circuit 3 has an m-bit shift register 5, a m×6-bit register 6, a m×6-bit latch 7, and D/A converters 8.

As such, in the source driver circuit 3, a start pulse SP is fed to the first register in the m-bit shift register 5 and transferred through the shift register 5 in accordance with a clock clk. Concurrently, the start pulse SP is also supplied to the m×6-bit register 6 as timing pulses SSP.

The m×6-bit register 6 receives and holds 6-bit data signals Dx at their corresponding locations by the timing pulses SSP supplied from the shift register 5.

The data signals Dx thus held by the m×6-bit register 6 is held by the m×6-bit latch 7 at a latch signal LP for a later output to the D/A converter circuit 8.

The D/A converter 8 converts the incoming data signals Dx to corresponding voltages Vda and supplies the voltages Vda to the source lines Sj.

Thus, the source driver circuit 3 of the present embodiment is arranged similarly to an source driver IC used in an amorphous silicon TFT liquid crystal or the like.

The gate driver circuit 4 is made up of an n-bit shift register 9 and a logical circuit 10. An input start pulse Sy is transferred through the n-bit shift register 9 in accordance with a clock yck. The gate driver circuit 4 performs logical operations in accordance with a timing signal OEy and applies a signal to associated control lines Gi, Wi, Ri via a buffer.

FIG. 1 shows a pixel circuit structure in accordance with the present invention for the First Embodiment.

The pixel circuit Aij has a driver TFT (driver transistor) Q1 and an organic EL (electro-optical element) EL1 connected in series between and a power supply line Vp and a common cathode Vcom.

In FIG. 1, an initialization section is realized by Vb, G1, Q3, a threshold correcting section is realized by Sj, G1, Q2, Va, Q5, C1, C2, and a signal control section is realized by Ri, W1, Q4, C1.

Here, Vda is a voltage for threshold correction, and Vda−Va is a voltage for signal control.

The source line Sj is the first line, the voltage line Va is the second line, and the voltage line Vb is the third line.

Assume that a node of the source terminal of the driver TFT Q1 and the anode of the organic EL EL1 is node B. In this case, the capacitor C1 (first capacitor) and the capacitor C2 (second capacitor) are connected in series between the gate terminal of the driver TFT Q1 and the node B.

Further, the switching TFT Q2 (first switching transistor) is disposed between the gate terminal of the driver TFT Q1 and the source line Sj (first line in the present embodiment).

Assume that a node of the capacitor C1 and the capacitor C2 is node A. In this case, the switching TFT Q5 (second switching transistor) is disposed between the node A and the voltage line Va (second line in the present embodiment).

Further, as the first initialization arrangement, the switching TFT Q3 (third switching transistor) is disposed between the node B and the voltage line Vb (third line).

Still further, as the first changing means, the switching TFT Q4 (fourth switching transistor) is disposed in parallel to the capacitor C1.

In the pixel circuit aij, the driver TFT Q1 and the switching TFTs Q2 through Q5 are all n-type TFTs. Further, the gate terminals of the switching TFTs Q2 and Q3 are connected to the gate line Gi, the gate terminals of the switching TFTs Q4 and Q5 are connected to the control lines R1 and Wi.

Figure 3:
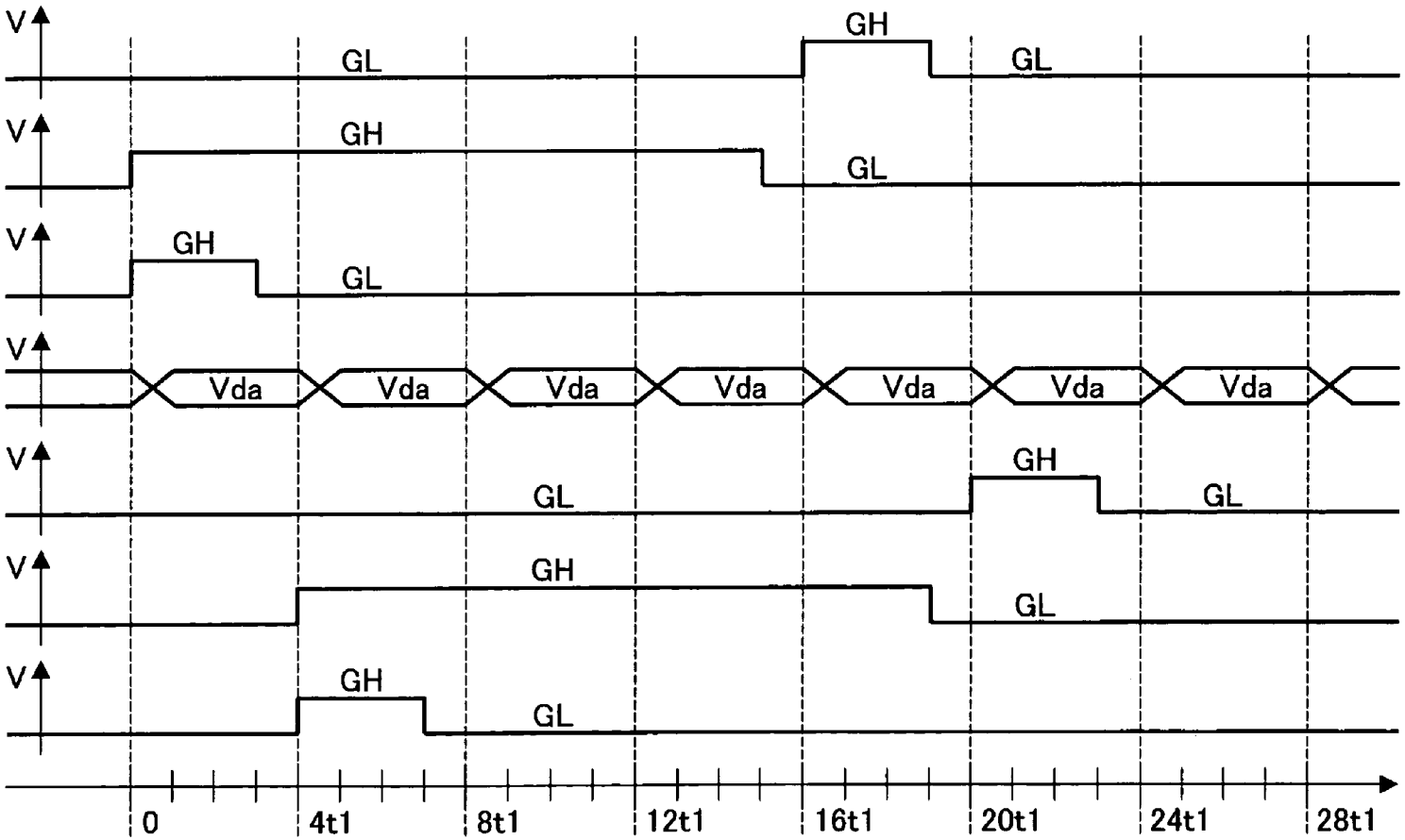
FIG. 3 is a timing chart showing voltages on lines of the pixel circuit illustrated in FIG. 1.

The following will describe the operation of the pixel circuit Aij with reference to a timing chart illustrated in FIG. 3.

FIG. 3 shows timings indicated by voltages on 1) the control line Ri, 2) the control line Wi, 3) the gate line Gi, and 4) the source line Sj in the pixel circuit Aij. 5) R(i+1), 6) W(i+1), and 7) G(i+1) are those for a subsequent pixel A(i+1)j.

The present embodiment adopts the first drive method, and a time 0 to 3*t*1 is therefore a select period of the pixel Aij and corresponds to a first period.

During the first period, the gate line Gi is set to GH (High), so that the switching TFTs Q2 and Q3 are turned on, and the data voltage Vda (desired voltage) is applied from the source line Sj to the gate terminal of the driver TFT Q1. Further, the voltage Vb (predetermined voltage) is fed from the voltage line Vb to the node B. The voltage Vb fed to the node B during the first period is lower than Vcom.

Then, the control line Wi is set to GH (High), so that the switching TFT Q5 is turned on, and the voltage Va is fed from the voltage line Va to the node A.

Since the node B is coupled to the anode of the electro-optical element (EL1), the voltage Vs is set to be lower than Vcom.

At this moment, a value of the voltage Vs of the node B is set to be lower than Vda (min)−Vth. Vda (min) indicates a minimum voltage out of the data voltages Vda. Vth can vary depending on the driver TFT Q1. Considering the variation of Vth, a value of the voltage Vs of the node B should be set to be lower than Vda (min)−Vth (max). The same holds true for the following descriptions. Vth (max) indicates the worst (maximum) voltage out of threshold voltage variations of the driver TFT Q1.

Therefore, there is the following relation:

$$Vs<Vcom\ Vs<Vda(\mathrm{min})-Vth.$$

Considering the variation of Vth, there is the following relation:

$$Vs<Vcom$$

$$Vs<Vda(\mathrm{min})-Vth(\mathrm{max}).$$

During a second period from time 3*t*1 to 15*t*1, the gate line Gi is set to GL (Low).

At this time, the switching TFTs Q2 and Q3 are turned off, but the gate terminal voltage Vda of the driver TFT Q1 is retained since the switching TFT Q5 keeps being turned on.

On the other hand, the source terminal voltage of the driver TFT Q1 rises and gradually changes to Vda−Vth. After the change is almost completed, the control line Wi is set to GL, turning off the switching TFT Q5.

Thereafter, during a third period from time 16*t*1 to 19*t*1, the control line Ri is set to GH, turning on the switching TFT Q4.

As a result of this, the voltage Vda−Va stored in the capacitor C1 disappears, and the gate-to-source voltage of the driver TFT Q1 becomes Va−(Vda−Vth).

Therefore, the gate-to-source voltage of the driver TFT Q1 becomes a voltage obtained by subtracting the threshold Vth from the voltage Va−Vda. Thus, it is possible to control a value Ids of a current flowing through the driver TFT Q1, on the basis of a relation between the data voltage Vda fed from the source line Sj in the select period and the voltage Va of the voltage line Va.

More specifically, Ids is almost zero if the data voltage Vda is higher than the voltage Va of the voltage line. If the data voltage Vda is lower than the voltage Va of the voltage line, the value Ids of the current flowing through the driver TFT Q1 is expressed as follows:

$$Ids = (W/L)\mu \cdot Co \cdot (Vgs - Vth)^2$$
$$= (W/L)\mu \cdot Co \cdot (Va - (Vda - Vth) - Vth)^2$$
$$= (W/L)\mu \cdot Co \cdot (Va - Vda)^2$$

where W is a gate width of the driver TFT Q1, L is a gate length of the driver TFT Q1, μ is mobility of the driver TFT Q1, Co is a constant determined by a thickness of a gate insulating film and others. This assumes that the drain-to-source voltage Vds of the driver TFT Q1 is sufficiently higher than the gate-to-source voltage Vgs−Vth.

In the pixel circuit illustrated in FIG. 1, the TFT Q1 is n-type TFT. In this case, for example, Va should be a voltage of approximately 5V when the data voltage Vda ranges from 0V to 5V. At this time, since Ids is expressed by:

$$Ids=(W/L)\mu \cdot Co \cdot (Va-Vda)^2,$$

the highest current flows when Vda is 0V, and the lowest current flows when Vda is 5V. Actually, Va can be designed to be approximately 4.5 V in order to make Ids=0 when it is Vda=Va, in consideration of the influence of stray capacitance and others.

This evidences that with the use of the pixel circuit illustrated in FIG. 1, the value Ids of the current flowing through the driver TFT Q1 is determined by the data voltage Vda and the voltage Va of the voltage line Va, regardless of the threshold Vth.

Figure 4:
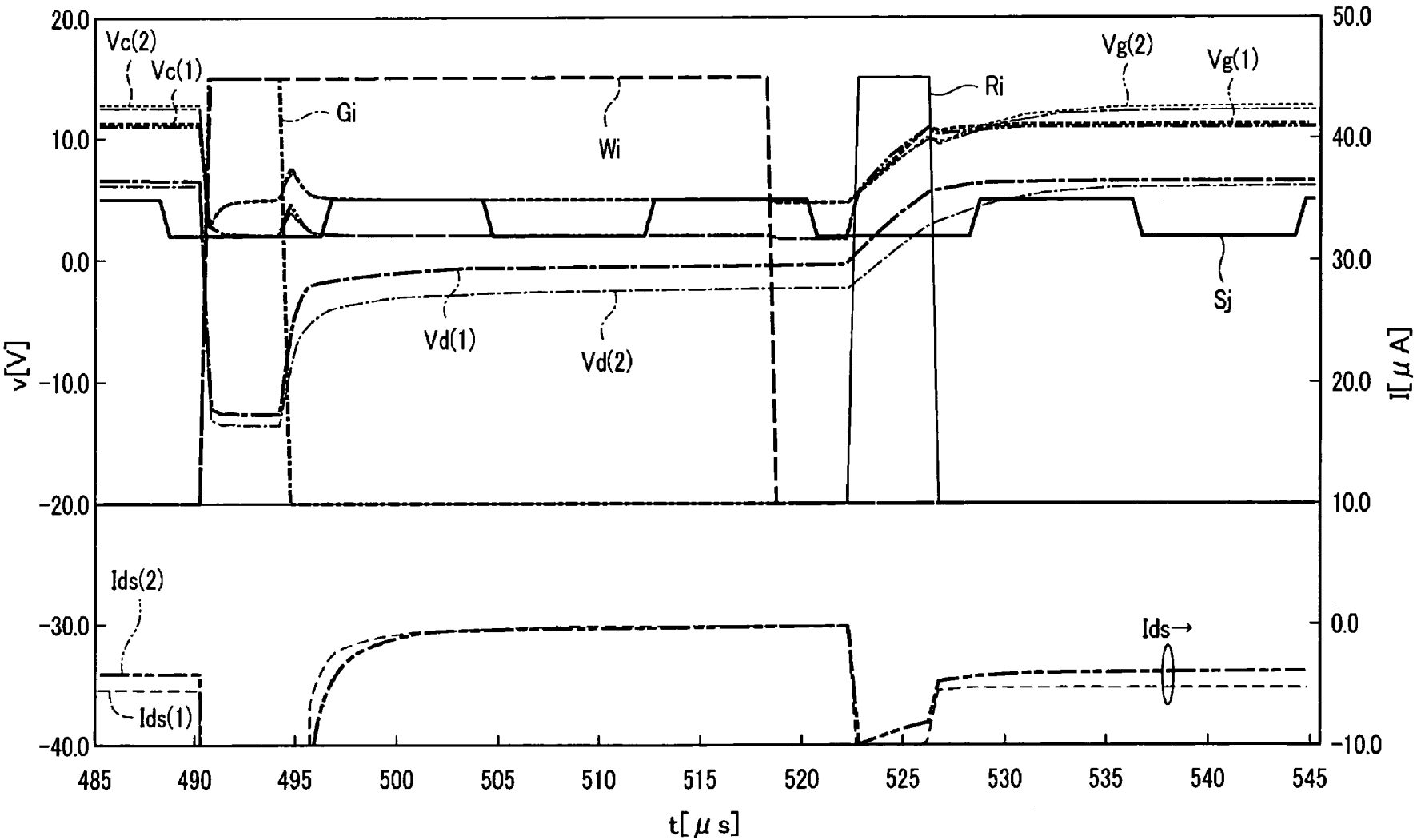
FIG. 4 is a graph showing the progression of currents Ids between a source and a drain of a driver TFT Q1 as a result of the simulation in the pixel circuit illustrated in FIG. 1.

FIG. 4 shows the results from the simulation of supplying the signals illustrated in FIG. 3 to the pixel circuit illustrated in FIG. 1.

This simulation assumes that GL=−20V, GH=15V, Vcom=0V, Vp=12V, Va=5V, Vb=−15V, Vda=2V and 5V, C1=500 fF, and C2=500 fF.

Voltage Vc is a voltage of the node A, voltage Vd is a voltage of the node B, voltage Vg is a gate terminal voltage of the driver TFT Q1, current Ids is a current flowing between the drain and the source of the driver TFT Q1.

Vc(1), Vd(1), Vg(1), Ids(1) indicates that the threshold Vth of the driver TFT Q1 and the mobility p are in the best conditions. Vc(2), Vd(2), Vg(2), Ids(2) indicates that the threshold Vth of the driver TFT Q1 and the mobility μ are in the worst conditions.

According to the results from the simulation, the currents Ids(1) and Ids(2) are approximately −5.2 μA and −3.9 μA, respectively, which correspond to the variation of the mobility μ of the driver TFT Q1. This is the result from the compensation for the variation of the threshold Vth of the driver TFT Q1.

Figure 14:
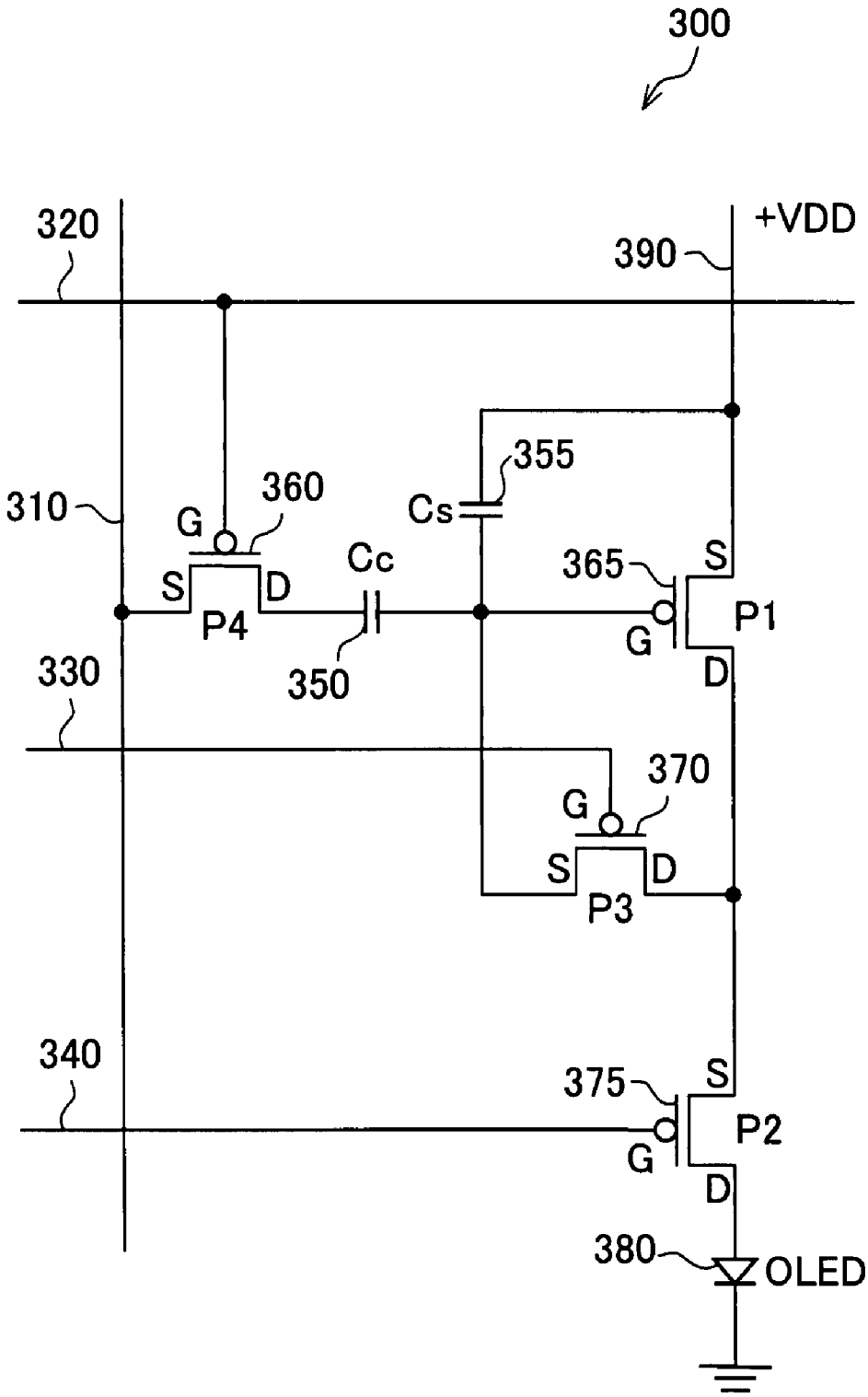
FIG. 14 is a circuit diagram illustrating the structure of a pixel circuit described in BACKGROUND ART.

Thus, the use of the means of the present invention eliminates a switching transistor between the driver transistor and the electro-optical element, unlike the example of FIG. 14 in the descriptions of the conventional art. This avoids the increase of power consumption caused by voltage drop in the switching transistor.

Especially, to realize the switching transistor by amorphous silicon, a size of the switching transistor increases. The display device of the present invention eliminates the need for such a switching transistor, thereby enabling a high aperture ratio in the bottom emission structure and a high definition in the top emission structure.

Figure 15:
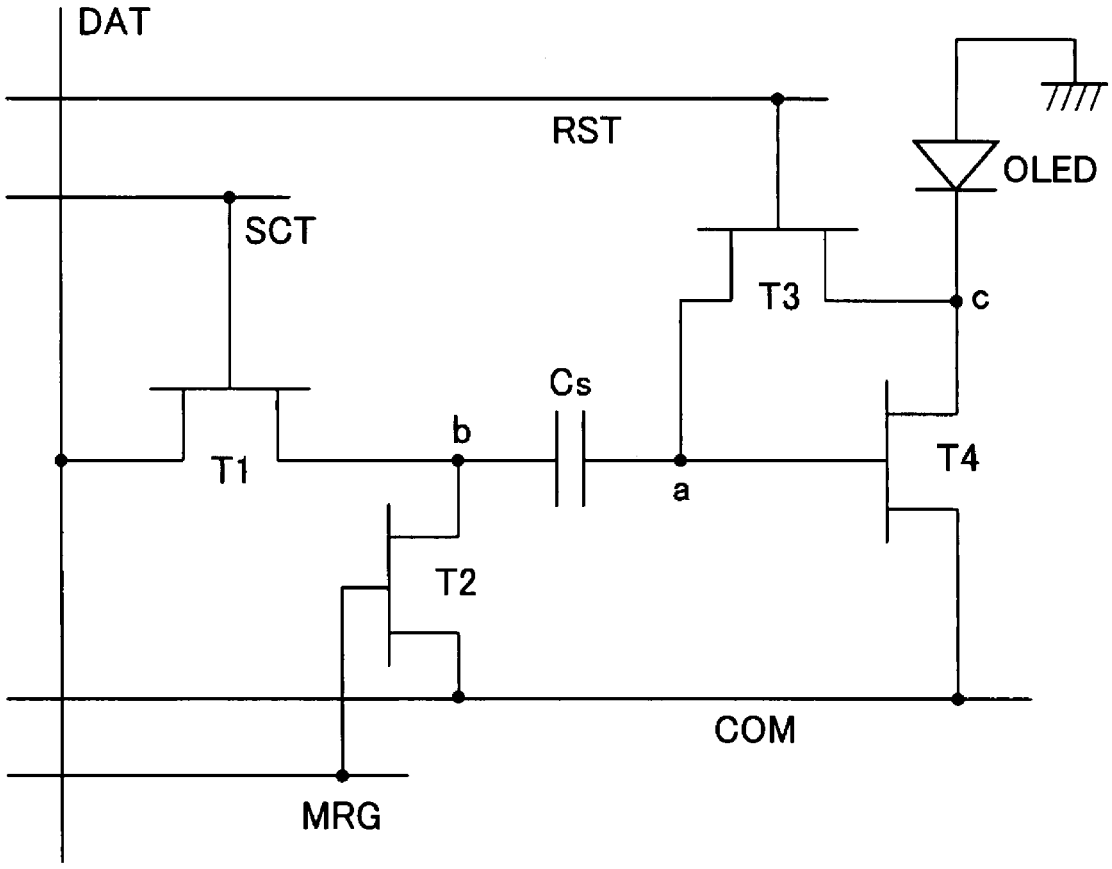
FIG. 15 is a circuit diagram illustrating the structure of another pixel circuit described in BACKGROUND ART.
Figure 16:
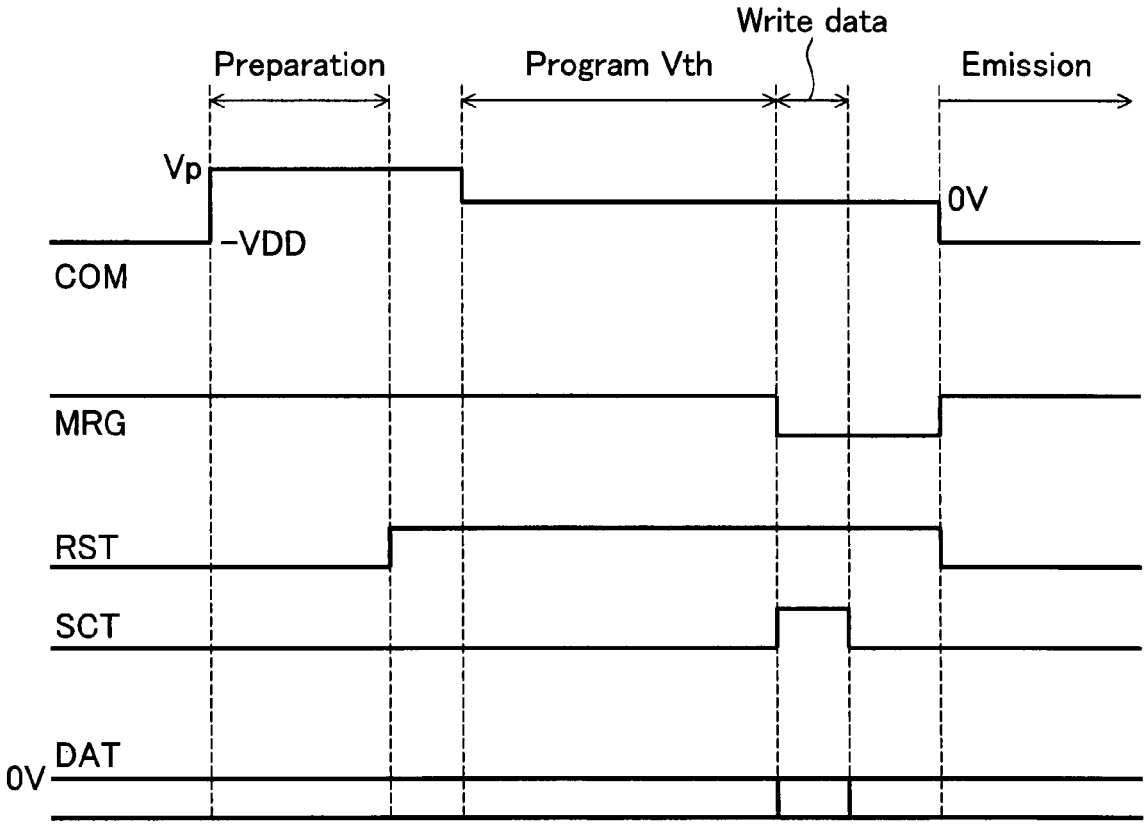
FIG. 16 is a timing chart showing the operation of the pixel circuit illustrated in FIG. 15.
Figure 17:
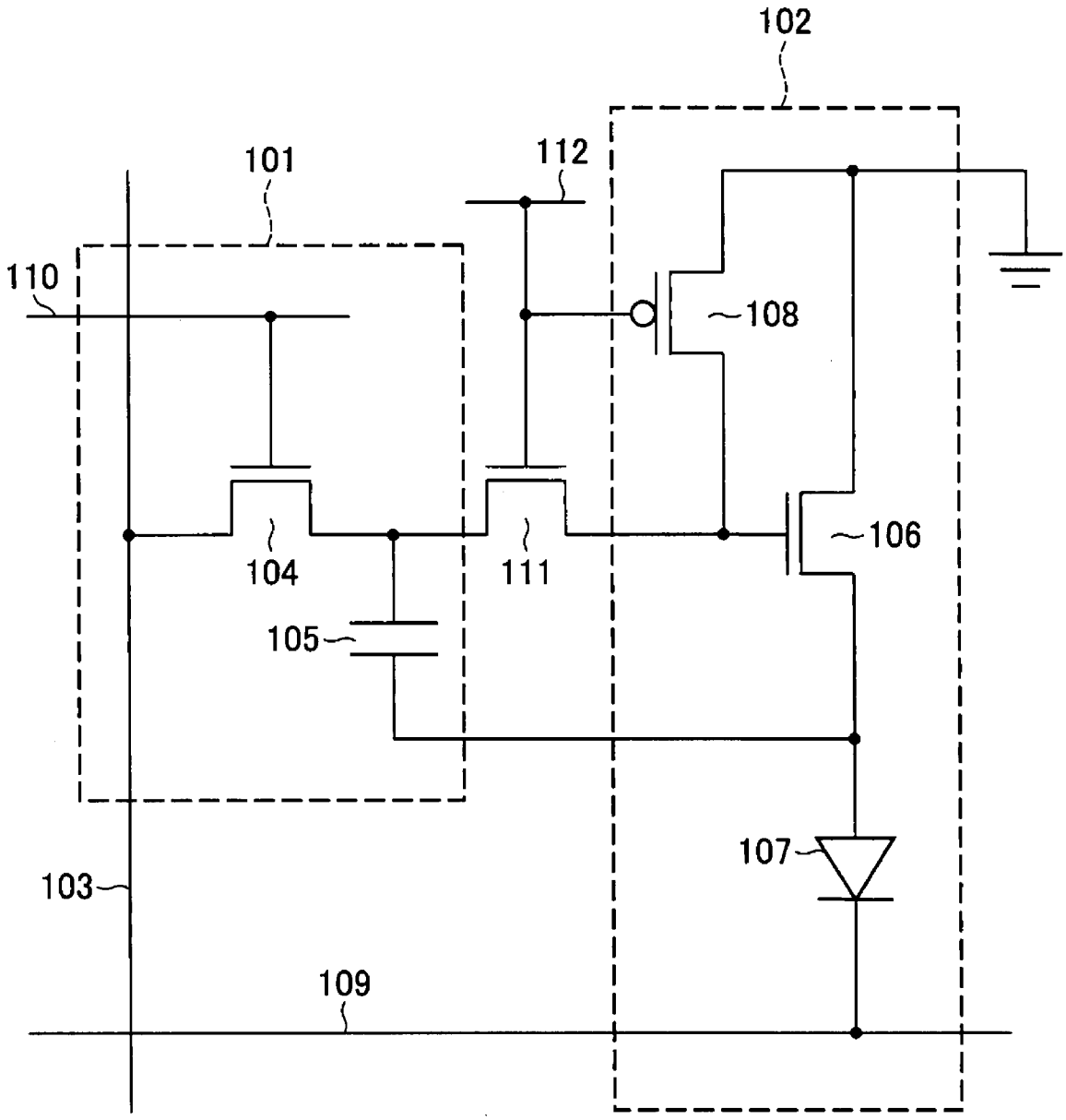
FIG. 17 is a circuit diagram illustrating the structure of still another pixel circuit described in BACKGROUND ART.
Figure 18:
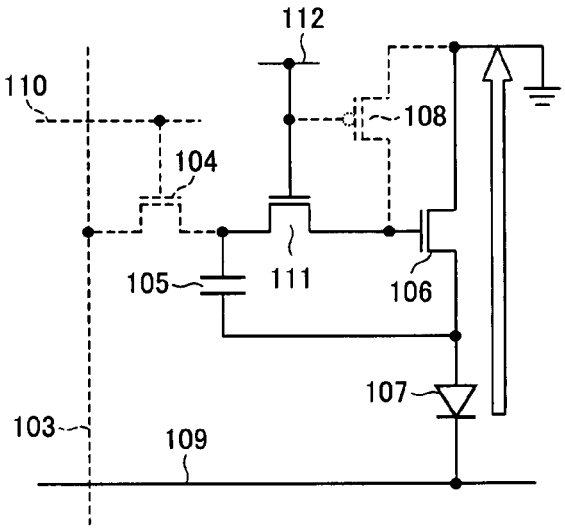
FIGS. 18(*a*) through 18(*d*) are circuit diagrams illustrating the operations of the pixel circuit illustrated in FIG. 17.
Figure 18:
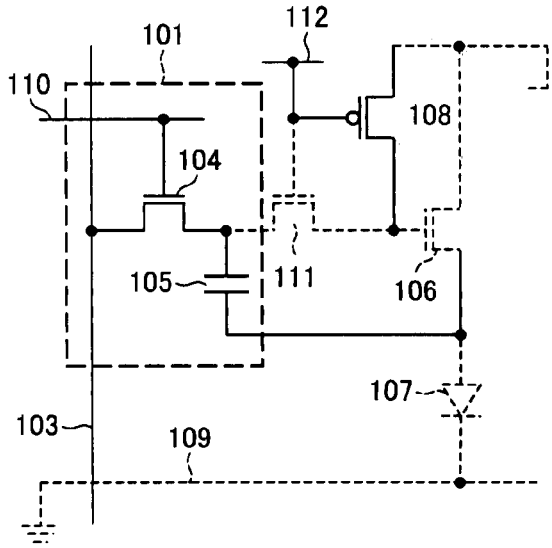
Figure 18:
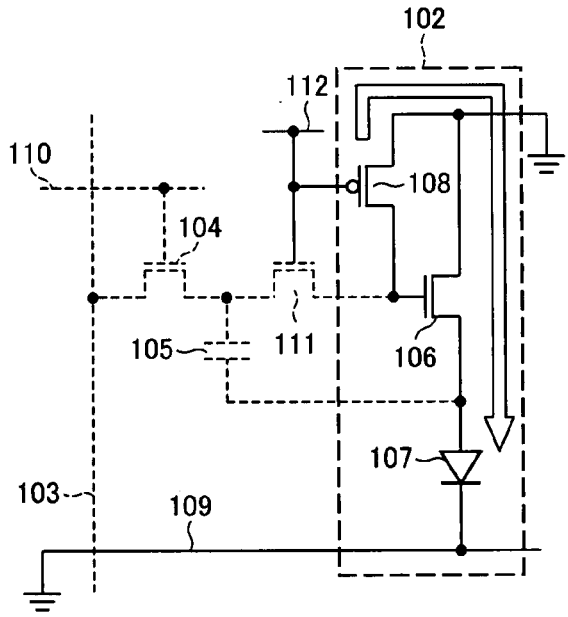
Figure 18:
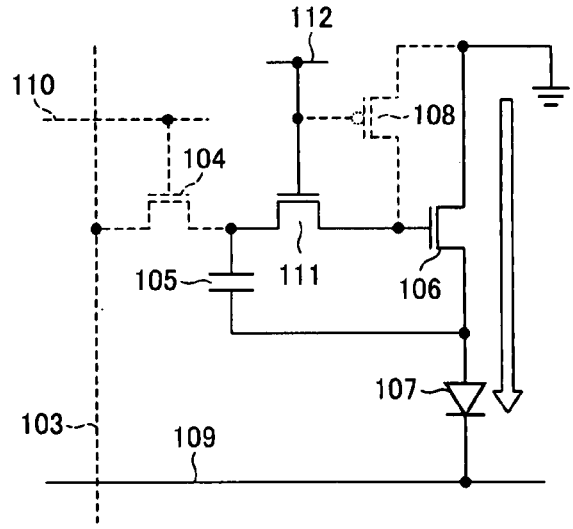

Further, since both of the voltages to be fed to the power supply line and the common electrode are DC voltages, it is possible to directly couple the power supply line and the common electrode to a DC power source, unlike the example of FIG. 15 in the descriptions of the conventional art. This eliminates the need for a switch disposed between the power supply line and the DC power source.

Thus, a substrate made from CG silicon TFT or polysilicon TFT eliminates the need for an external switch. This makes it possible to fabricate the driver circuit from CG silicon or polysilicon TFT, thus enabling cost reduction of the display device.

Further, a substrate made from amorphous silicon TFT eliminates the need for such a switch in a driver IC. Cost reduction of the driver IC leads to cost reduction of the display device.

Thus, the use of the means of the present invention evidently brings advantageous effects.

Note that when CG silicon TFT or polysilicon TFT is used as a TFT, p-type TFT can be used as the driver TFT. An example of a pixel circuit in such a case is shown in FIG. 5.

Figure 5:
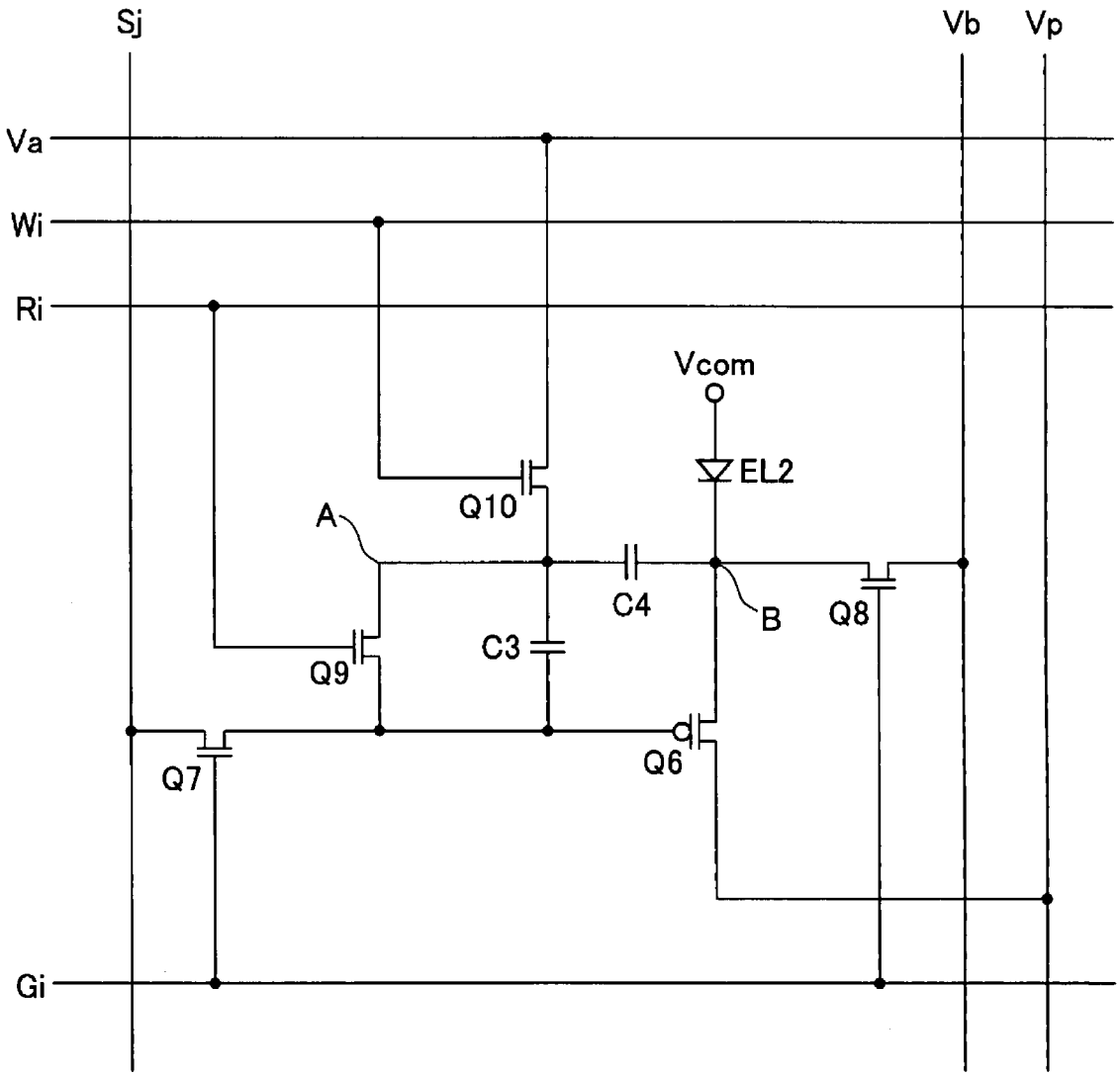
FIG. 5 is a circuit diagram illustrating the structure of another pixel circuit described in First Embodiment.

Timings of control signals in the pixel circuit of FIG. 5 are basically the same as those in the pixel circuit of FIG. 1. That is, the timings illustrated in FIG. 3 may be adopted.

In a pixel circuit Aij of FIG. 5, a threshold voltage Vth of a driver TFT Q6 is a negative value. A voltage Vb fed to a node B during the first period is higher than Vcom. That is, since the node B is coupled to a cathode of an electro-optical element (EL1), the voltage Vs of the node B is set to be higher than Vcom.

Therefore, there is the following relation:

$$Vs>Vcom$$

$$Vs>Vda(\min)-Vth$$

Considering the variation of Vth, there is the following relation:

$$Vs>Vcom$$

$$Vs>Vda(\min)-Vth(\max).$$

Then, the voltage Va is fed to the node A during the second period, and it is waited until the voltage of the node B changes to Vda−Vth.

Further, a switching TFT Q9 is turned on during the third period, which causes the gate-to-source voltage of the driver TFT Q6 to be Va−(Vda−Vth).

At this time, since the driver TFT Q6 is p-type TFT, the current Ids flowing through the driver TFT Q1 is almost zero if Va−Vda is not less than zero. If Va−Vda is negative, the current Ids flowing through the driver TFT Q1 becomes a desired value.

In the pixel circuit of FIG. 5, the TFT Q6 is p-type TFT. For example, in a case where the data voltage Vda ranged from 0V to 5V, Va should be a voltage of approximately 0V.

Thus, the means of the present invention is realized even when the node B is a cathode of an organic EL.

SECOND EMBODIMENT

In Second Embodiment, a display device using the means of the present invention and adopting the first driving method, the second initialization arrangement, and the first changing means will be described.

A display device 1 of the present embodiment has blocks arranged in the same manner as those in the display device 1 of First Embodiment. Explanation thereof is therefore omitted.

Signals outputted from a gate driver circuit 4 are supplied to control lines Ri and Wi, gate line Gi, and voltage line Ui.

Ui, W1, Q5, and C2 constitute an initialization section, Sj, G1, Q2, U1, Q5, C1, and C2 constitute a threshold correcting section, and Ri, W1, Q4, and C1 constitute a signal control section.

Here, Vda is a voltage for threshold correction, and Va is a voltage for signal control.

A source line Sj is a first line, and a voltage line Ui is a second line.

Figure 6:
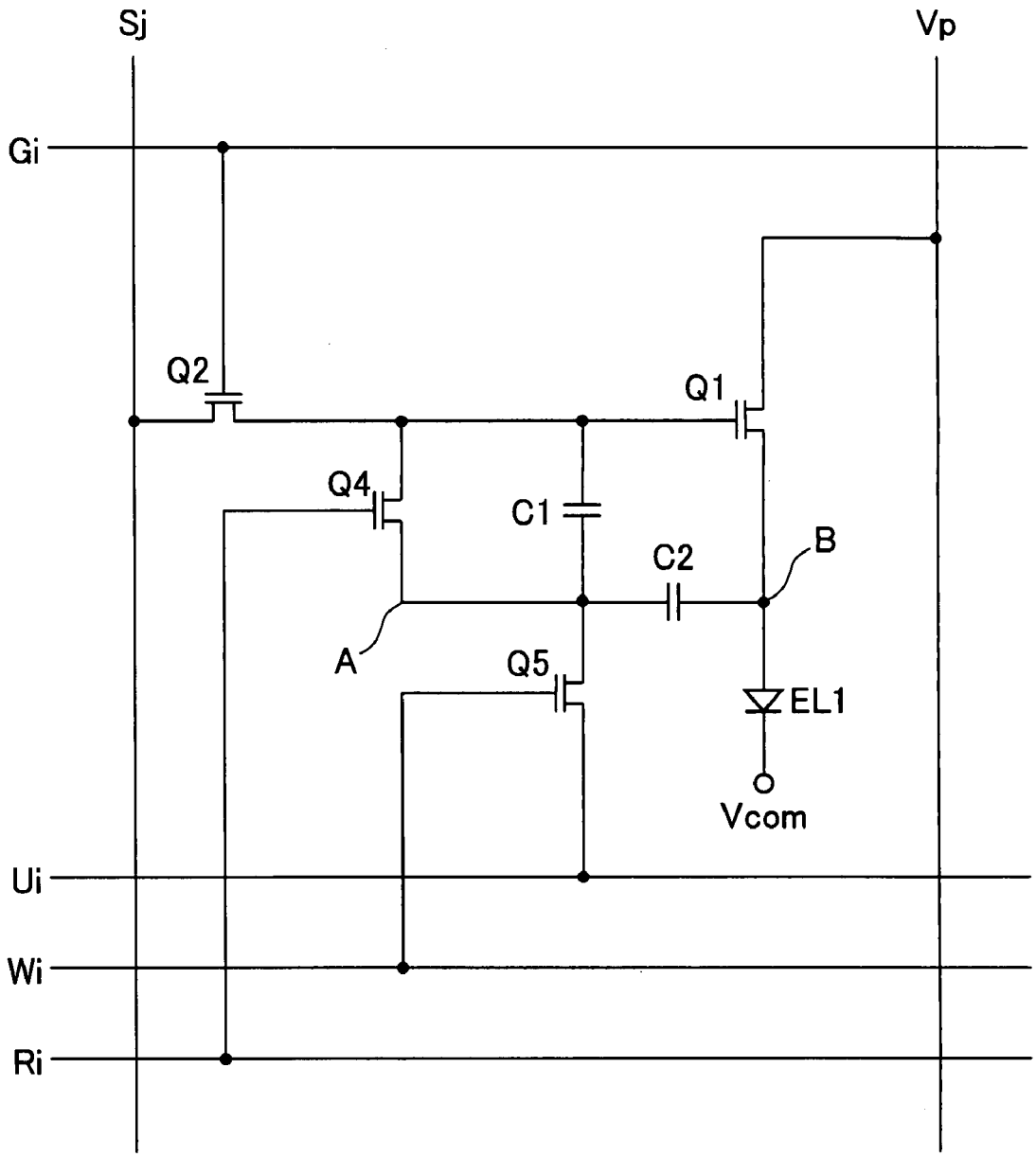
FIG. 6 is a circuit diagram illustrating the structure of a pixel circuit used in Second Embodiment.

A structure of the pixel circuit used in Second Embodiment is shown in FIG. 6.

That is, the pixel circuit Aij of FIG. 6 is such that the switching TFT Q3 (third switching transistor) and the voltage line Vb (third line) are removed from the pixel circuit Aij of FIG. 1, and the voltage line Va (second line in the present embodiment) is a voltage line Ui.

The other components are the same as those in the pixel circuit of FIG. 1, and explanation thereof is therefore omitted.

Figure 7:
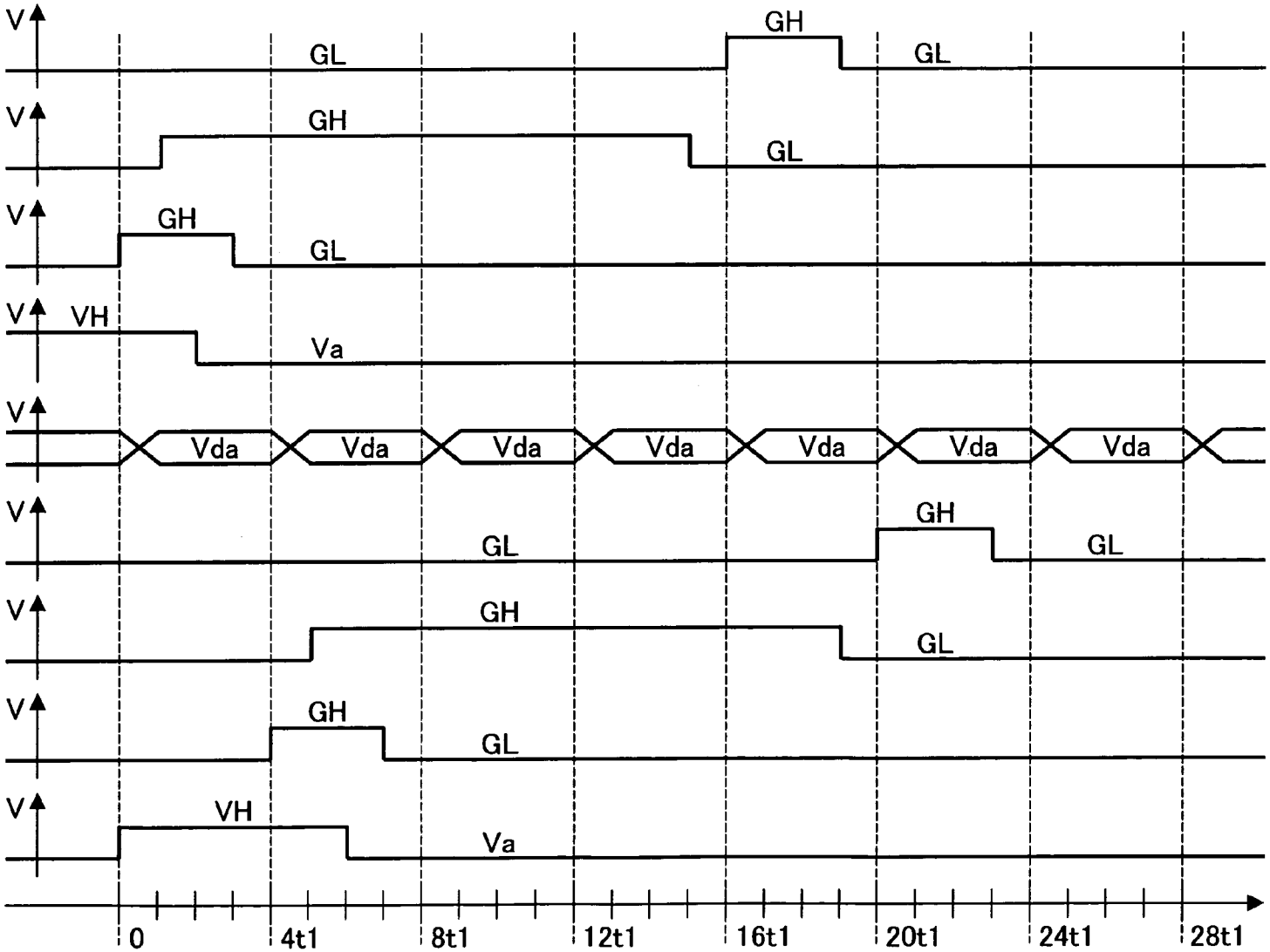
FIG. 7 is a timing chart showing voltages on lines of the pixel circuit illustrated in FIG. 6.

The following will describe the operation of the pixel circuit Aij with reference to a timing chart illustrated in FIG. 7.

FIG. 7 shows timings indicated by voltages on 1) the control line Ri, 2) the control line Wi, 3) the gate line Gi, and 4) the voltage line Ui, and 5) source line Sj in the pixel circuit Aij. 6) R(i+1), 7) W(i+1), 8) G(i+1), and 9) U(i+1) are those for a subsequent pixel A(i+1)j.

A time 0 to 3t1 is a select period of the pixel Aij and corresponds to a first period.

At time 0, the gate line Gi is set to GH, turning on the switching TFTs Q2 and Q3. At time t1, the control line Wi is set to GH, turning on the switching TFT Q5. With this, the data voltage Vda (desired voltage) is applied from the source line Sj to the gate terminal of the driver TFT Q1. Further, the voltage VH is fed from the voltage line Ui to the node A.

Next, at time 2t1, the voltage of the voltage line Ui is changed from VH to Va (predetermined voltage). Since this voltage change has influence on the node B through the capacitor C2, the voltage Vs of the node B is lower than Vda−Vth. It is preferable that the voltage Vs of the node B is lower than Vda(min)−Vth(max). The adjustment of the voltage Vs of the node B will be described in detail as follows. That is, the pixel circuit of FIG. 6 is such that the voltage of the node B is set to be a value lower than Vda−Vth, so that the voltage of the node A is changed. The node A and the node B are coupled to each other through the capacitor C2. If the voltage of the node A changes in a case where electric charges across the capacitor C2 are retained to some extent, the voltage of the node B changes. How much change of the voltage of the node A causes the voltage of the node B to be lower than Vda−Vth can be determined by measuring an actually fabricated product. It is preferable to make the determination in consideration of the actual situations: (a) other capacitor(s) coupled to the node B and (b) great variation of electric charge across the capacitor C2. Examples of other capacitor coupled to the node B includes a capacitor constituting an organic EL (model of an organic EL is the one in which a diode and a capacitor are coupled in parallel), and a source-to-gate capacitance of the TFT Q1.

Thereafter, at time 3t1, the voltage of the gate line Gi goes to GL, turning off the switching TFT Q2. However, since the control line Wi is still GH, the switching TFT Q5 keeps turned on, and the gate terminal voltage Vda of the driver TFT Q1 is retained through the capacitor C1.

From this time, the second period starts, and the voltage of the node B gradually changes to increase to Vda−Vth.

Then, after the change is almost completed, the control line Wi is set to GL, turning off the switching TFT Q5.

Thereafter, during the third period from time 16t1 to time 19t1, the control line Ri is set to GH, turning on the switching TFT Q4.

As a result of this, the voltage Vda−Va stored in the capacitor C1 disappears, and the gate-to-source voltage of the driver TFT Q1 becomes Va−(Vda−Vth).

In the pixel circuit of FIG. 6, there is the same relation between Va and Vda as in FIG. 1.

Therefore, the gate-to-source voltage of the driver TFT Q1 becomes a voltage obtained by subtracting the threshold Vth from the voltage Va−Vda. Thus, it is possible to control a value Ids of a current flowing through the driver TFT Q1, on the basis of a relation between the data voltage Vda fed from the source line Sj during the select period and the voltage Va of the voltage line Ui.

Figure 8:
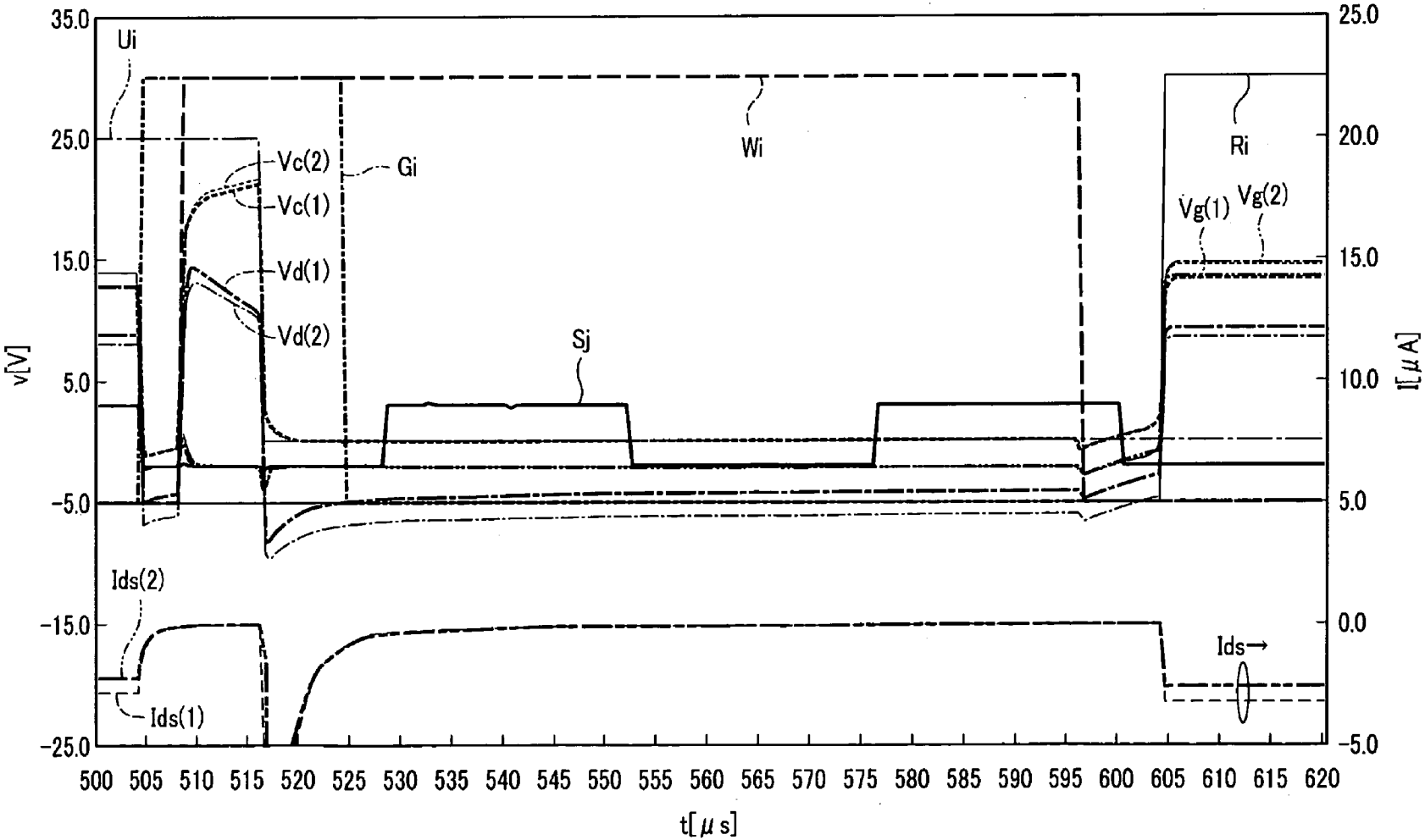
FIG. 8 is a graph showing the progression of currents Ids between a source and a drain of a driver TFT Q1 as a result of the simulation in the pixel circuit illustrated in FIG. 6.

FIG. 8 shows the results from the simulation of supplying the signals illustrated in FIG. 7 to the pixel circuit illustrated in FIG. 6.

This simulation assumes that GL=−5V, GH=30V, Vcom=0V, Vp=12V, VH=25V, Va=0V, Vda=−2V and 3V, C1=500 fF, and C2=5 pF.

Voltage Vc is a voltage of the node A, voltage Vd is a voltage of the node B, voltage Vg is a gate terminal voltage of the driver TFT Q1, current Ids is a current flowing between the drain and the source of the driver TFT Q1.

Vc(1), Vd(1), Vg(1), Ids(1) indicates that the threshold Vth of the driver TFT Q1 and the mobility μ are in the best conditions. Vc(2), Vd(2), Vg(2), Ids(2) indicates that the threshold Vth of the driver TFT Q1 and the mobility μ are in the worst conditions.

According to the results from the simulation, the currents Ids(1) and Ids(2) are approximately −3.2 μA and −2.6 μA, respectively, which correspond to the variation of the mobility μ of the driver TFT Q1. This is the result from the compensation for the variation of the threshold Vth of the driver TFT Q1.

Thus, the means of the present invention is realized without the switching TFT Q3 (third switching transistor) and the voltage line Vb (third line).

THIRD EMBODIMENT

In Third Embodiment, a display device using the means of the present invention and adopting the second driving method, the first initialization arrangement, and the second changing means will be described.

A display device 1 of the present embodiment has blocks arranged in the same manner as those in the display device 1 of First Embodiment. Explanation thereof is therefore omitted.

Figure 9:
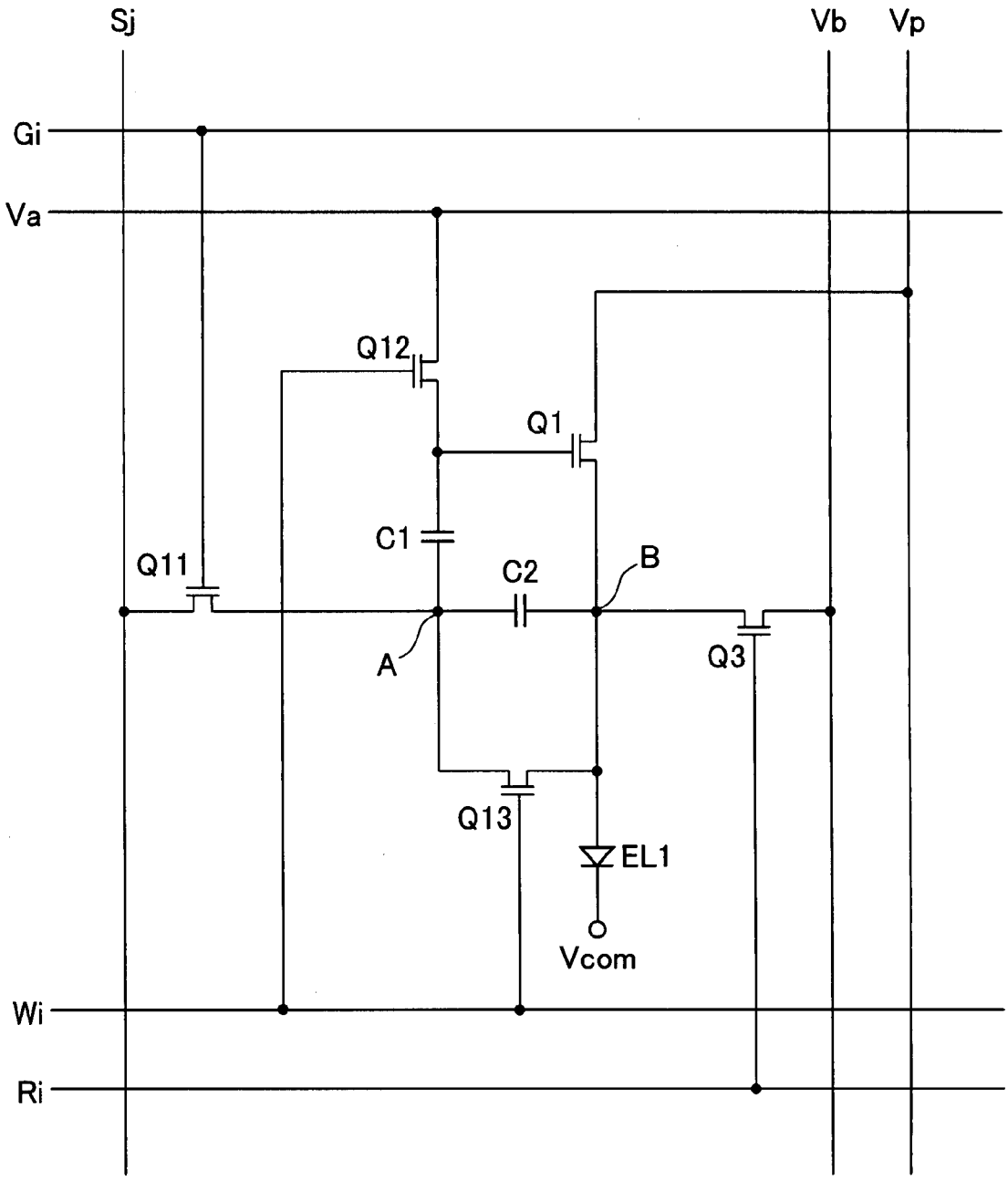
FIG. 9 is a circuit diagram illustrating the structure of a pixel circuit used in Third Embodiment.

A structure of the pixel circuit used in the present embodiment is shown in FIG. 9. In FIG. 9, Vb, Ri, and Q3 constitute an initialization section, Wi, Va, Q12, Q13, C1, and C2 constitute a threshold correcting section, and Sj, G1, Q1, Ri, and C2 constitute a signal control section.

Here, Va is a voltage for threshold correction, and Vda is a voltage for signal control.

The voltage line Va is a first line, the source line Sj is a second line, and the voltage line Vb is a third line.

The present arrangement is such that the TFT Q13 is disposed in parallel with the capacitor C2, so that a voltage V0 stored in the capacitor C2 throughout the first period can be set to zero.

The pixel circuit Aij is such that a driver TFT Q1 (driver transistor) and an organic EL EL1 (electro-optical element) are directly connected in series between a power supply line Vp and a common cathode Vcom.

Between a gate terminal of the driver TFT Q1 and the node B, the capacitor C1 (first capacitor) and the capacitor C2 (second capacitor) are connected in series.

Between the gate terminal of the driver TFT Q1 and the voltage line Va (first line in the present embodiment), the switching TFT Q12 (first switching transistor) is disposed.

Between a node A of the capacitor C1 and the capacitor C2 and the source line Sj (second line in the present embodiment), the switching TFT Q11 (second switching transistor) is disposed.

Further, as the first initialization arrangement, the switching TFT Q3 (third switching transistor) is disposed between the node B and the voltage line Vb (third line).

Still further, as the first changing means, the switching TFT Q13 (fourth switching transistor) is disposed in parallel with the capacitor C2.

In the pixel circuit Aij, the driver TFT Q1 and the switching TFTs Q2 through Q5 are all n-type TFTs. Further, the gate line Gi is connected to the gate terminal of the switching TFT Q11, the control line Wi is connected to the gate terminals of the switching TFTs Q12 and Q13, and the control line Ri is connected to the gate terminal of the switching TFT Q3.

Figure 10:
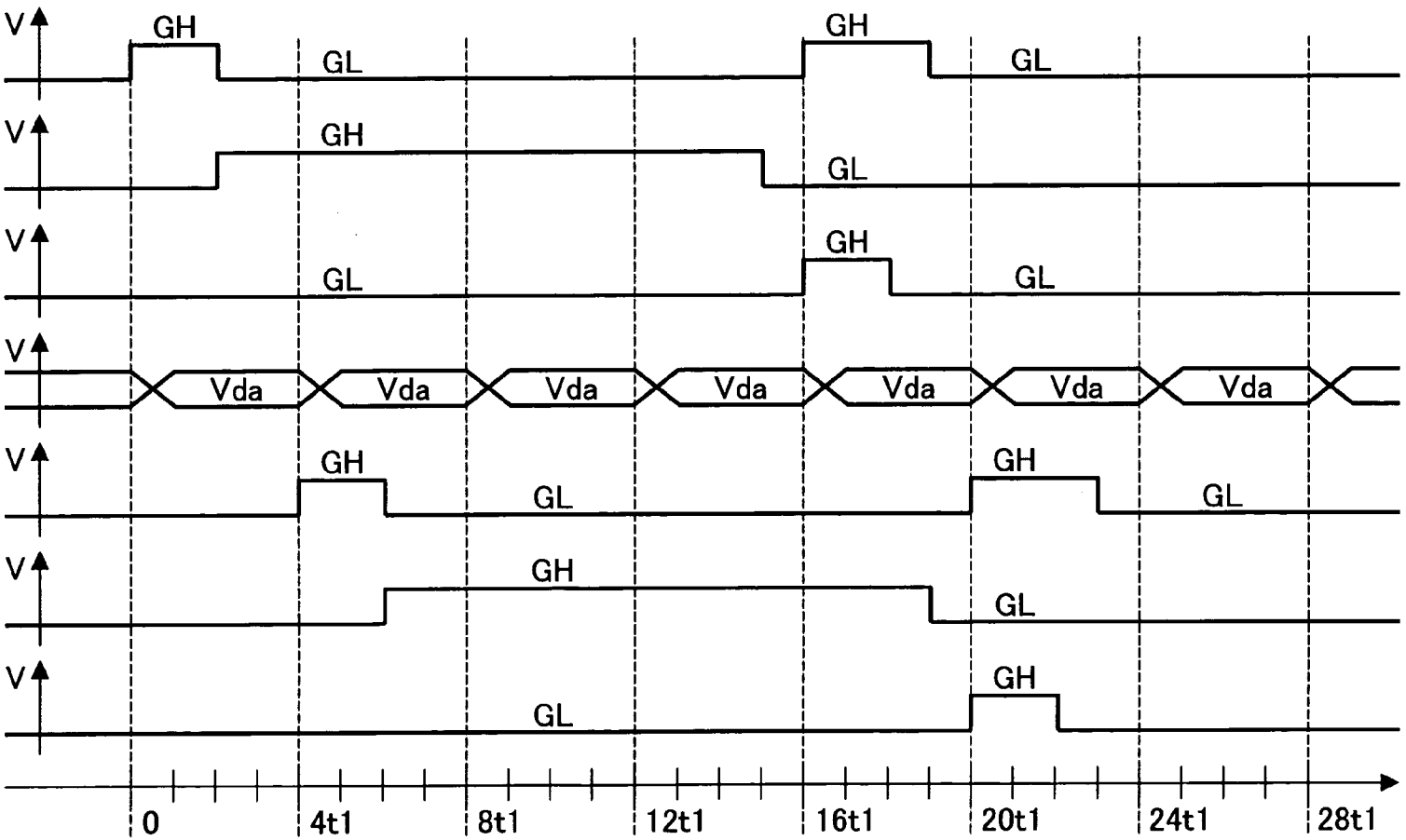
FIG. 10 is a timing chart showing voltages on lines of the pixel circuit illustrated in FIG. 9.

The following will describe the operation of the pixel circuit Aij with reference to a timing chart illustrated in FIG. 10.

FIG. 10 shows timings indicated by voltages on 1) the control line Ri, 2) the control line Wi, 3) the gate line Gi, and 4) the source line Sj in the pixel circuit Aij. 5) R(i+1), 6) W(i+1), and 7) G(i+1) are those for a subsequent pixel A(i+1)j.

Since the present embodiment adopts the second driving method, and a time 0 to 3t1 is therefore an initialization period prior to the first period.

In the time 0 to 3t1, the control line Ri is set to GH, turning on the switching TFT Q3, and making the voltage of the node B equal to a voltage Vb of the voltage line Vb.

Note that the voltage Vb is lower than Va−Vth (max) (Vth (max) is the worst threshold voltage in threshold variations of the driver TFT Q1.).

Next, at time 2t1, the control line Ri is set to GL (or the control line Ri can switch to GL at time t1), turning off the switching TFT Q3 and entering the first period at the same time. Then, the control line Wi is set to GH, turning on the switching TFTs Q12 and Q13. This applies a voltage Va (predetermined voltage) from the voltage line Va to the gate terminal of the driver TFT Q1. Further, voltage difference V0 across the capacitor C2 is held to zero.

Thereafter, since a gate terminal voltage Va of the driver TFT Q1 is retained, the source terminal voltage of the driver TFT Q1 rises, and the voltage of the node B gradually changes to Vda−Vth. After the change is almost completed, the control line Wi is set to GL, turning off the switching TFTs Q12 and Q13.

As a result of this, voltage difference Vth is retained at the capacitor C1.

Thereafter, during a second period from time 16t1 to 18t1, the gate line Gi and the control line Ri are set to GH.

This turns on the switching TFTs Q11 and Q3, supplies the voltage Vda of the source line Sj to the node A, and supplies the voltage Vb of the voltage line Vb to the node B.

As a result of this, voltage V0 stored in the capacitor C2 changes from 0 to Vda−Vb, and the gate-to-source voltage driver TFT Q1 changes from Vth to Vth+(Vda−Vb).

Therefore, the gate-to-source voltage of the driver TFT Q1 becomes a voltage obtained by subtracting the threshold Vth from the voltage Vda−Vb. Thus, it is possible to control a value Ids of a current flowing through the driver TFT Q1, on the basis of a relation between the data voltage Vda fed from the source line Sj during the select period and the voltage Vb of the voltage line Vb.

More specifically, Ids is almost zero if the data voltage Vda is lower than the voltage Vb of the voltage line. If the data voltage Vda is higher than the voltage Vb of the voltage line, the value Ids of the current flowing through the driver TFT Q1 is expressed as follows:

$$\begin{aligned} Ids &= (W/L)\mu \cdot Co \cdot (Vgs - Vth)^2 \\ &= (W/L)\mu \cdot Co \cdot (Vth + (Vda - Vb) - Vth)^2 \\ &= (W/L)\mu \cdot Co \cdot (Vda - Vb)^2 \end{aligned}$$

where W is a gate width of the driver TFT Q1, L is a gate length of the driver TFT Q1, μ is mobility of the driver TFT Q1, Co is a constant determined by a thickness of a gate insulating film and others. This assumes that the drain-to-source voltage Vds of the driver TFT Q1 is sufficiently higher than the gate-to-source voltage Vgs−Vth.

In the arrangement illustrated in FIG. 9, a value of Va is almost the same as that of Vcom because a voltage of the node B is Va−Vth. This causes Va−Vth to be lower than Vcom, so that a reverse voltage is applied to the organic EL.

This evidences that with the use of the pixel circuit illustrated in FIG. 9, the value Ids of the current flowing through the driver TFT Q1 is determined by the data voltage Vda and the voltage Vb of the voltage line, regardless of the threshold Vth.

Figure 11:
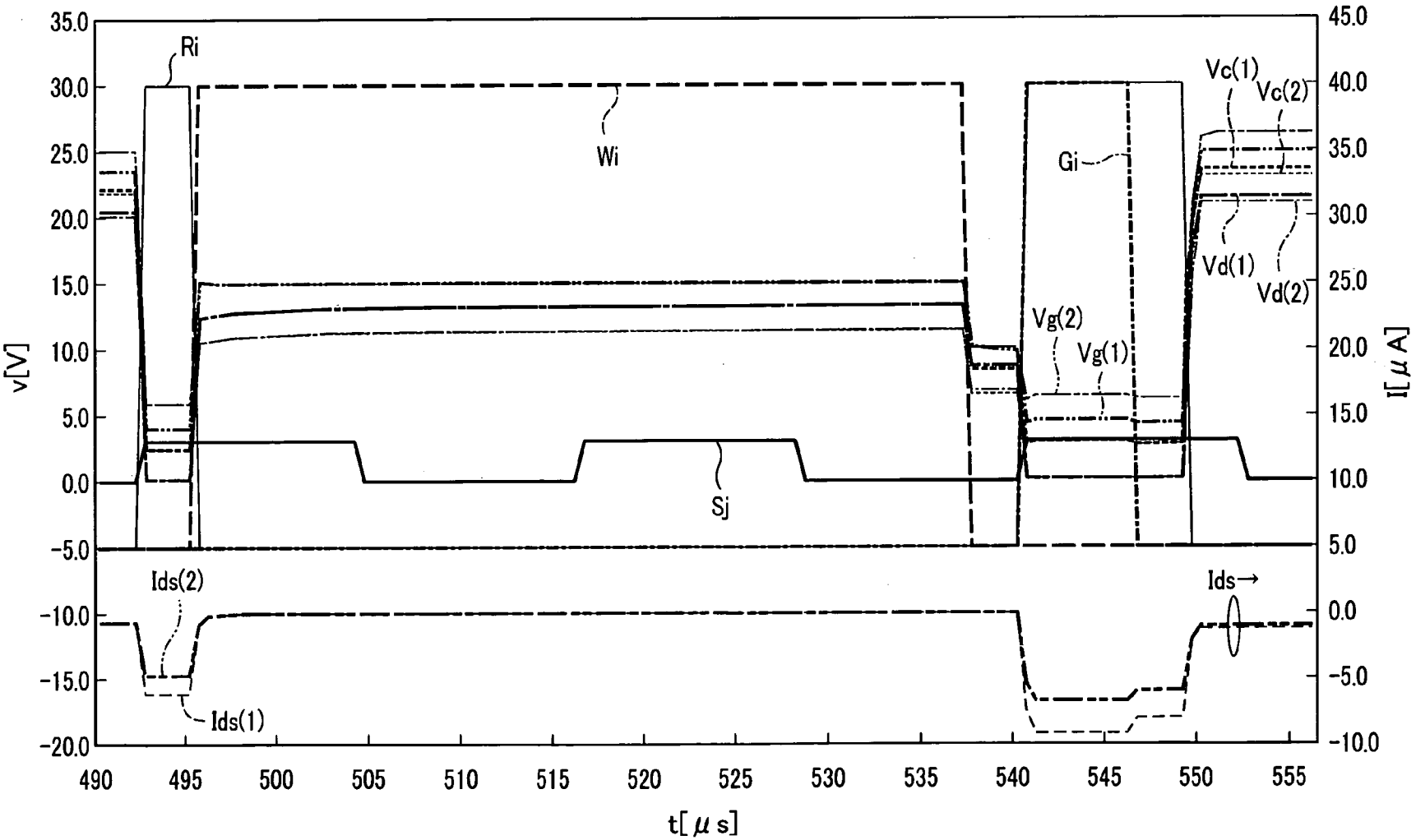
FIG. 11 is a graph showing the progression of currents Ids between a source and a drain of a driver TFT Q1 as a result of the simulation in the pixel circuit illustrated in FIG. 9.

FIG. 11 shows the results from the simulation of supplying the signals illustrated in FIG. 10 to the pixel circuit illustrated in FIG. 9.

This simulation assumes that GL=−5V, GH=30V, Vcom=15V, Vp=27V, Va=15V, Vb=0V, Vda=0V and 3V, C1=500 fF, and C2=500 fF.

Voltage Vc is a voltage of the node A, voltage Vd is a voltage of the node B, voltage Vg is a gate terminal voltage of the driver TFT Q1, current Ids is a current flowing between the drain and the source of the driver TFT Q1.

Vc(1), Vd(1), Vg(1), Ids(1) indicates that the threshold Vth of the driver TFT Q1 and the mobility μ are in the best conditions. Vc(2), Vd(2), Vg(2), Ids(2) indicates that the threshold Vth of the driver TFT Q1 and the mobility μ are in the worst conditions.

According to the results from the simulation, the currents Ids(1) and Ids(2) are approximately −1.2 μA and −1.0 μA, respectively, which correspond to the variation of the mobility μ of the driver TFT Q1. This is the result from the compensation for the variation of the threshold Vth of the driver TFT Q1.

FOURTH EMBODIMENT

In Fourth Embodiment, a display device using the means of the present invention and adopting the second driving method, the first initialization arrangement, and the second changing means will be also described.

A display device 1 of the present embodiment has blocks arranged in the same manner as those in the display device 1 of First Embodiment. Explanation thereof is therefore omitted.

Figure 12:
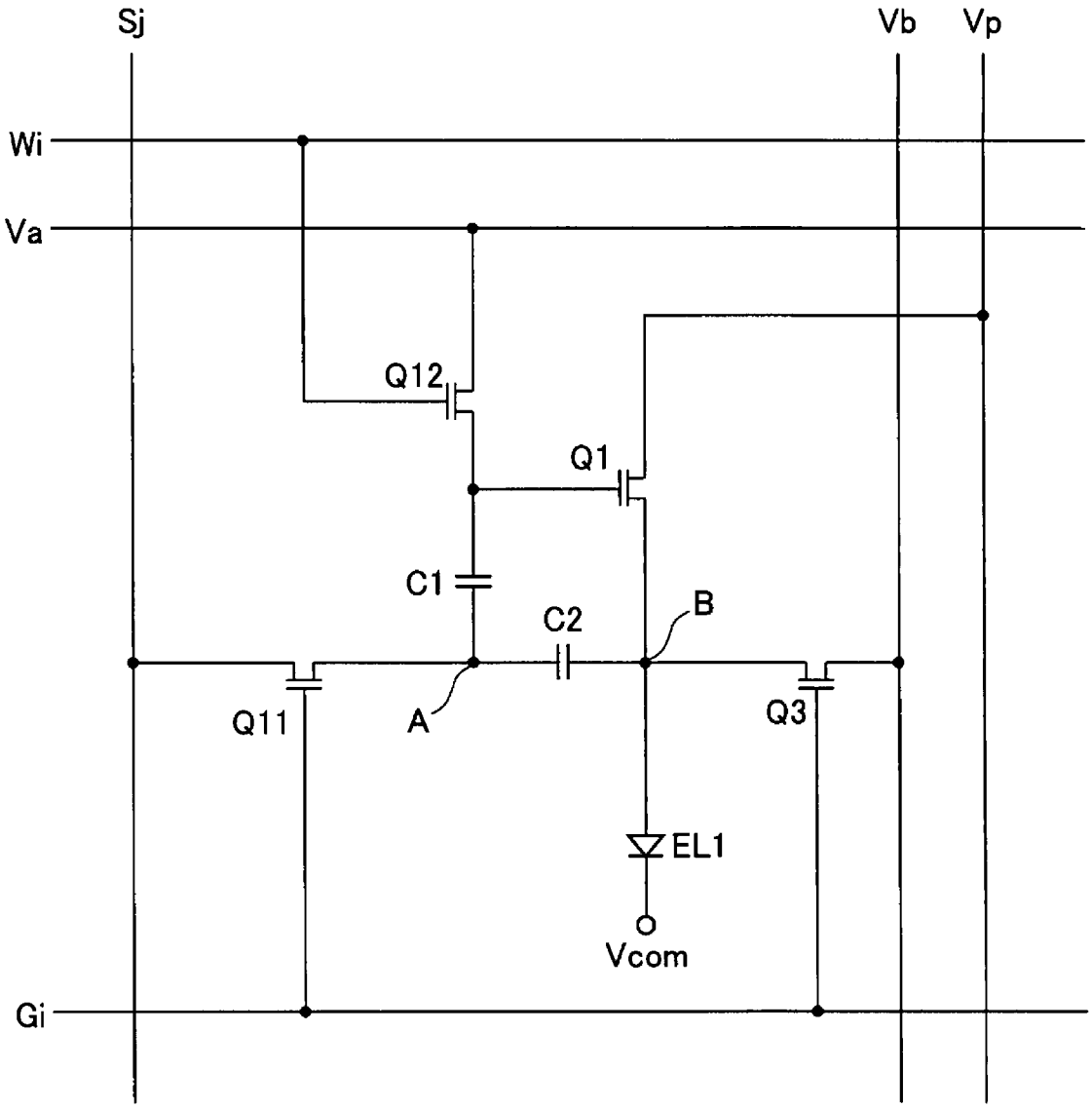
FIG. 12 is a circuit diagram illustrating the structure of a pixel circuit used in Fourth Embodiment.

A structure of the pixel circuit used in Fourth Embodiment is shown in FIG. 12.

That is, the pixel circuit is arranged such that the switching TFT Q13 (fourth switching transistor) is removed from the pixel circuit of FIG. 9.

Vb, Gi, and Q3 constitute an initialization section, Va, W1, Q12, C1, and C2 constitute a threshold correcting section, and Gi, Sj, Vb, Q11, Q3, and C2 constitute a signal control section.

Here, Va is a voltage for threshold correction, and Vda is a voltage for signal control.

The voltage line Va is a first line, the source line Sj is a second line, and the voltage line Vb is a third line.

In the present embodiment, one control line (Ri) is removed and a gate line Gi is used for the control of the gate-to-source voltage Vgs.

The present arrangement is an example of the arrangement which enables voltage V0 stored in the capacitor C2 throughout the first period and the second period to be nonzero value.

Figure 13:
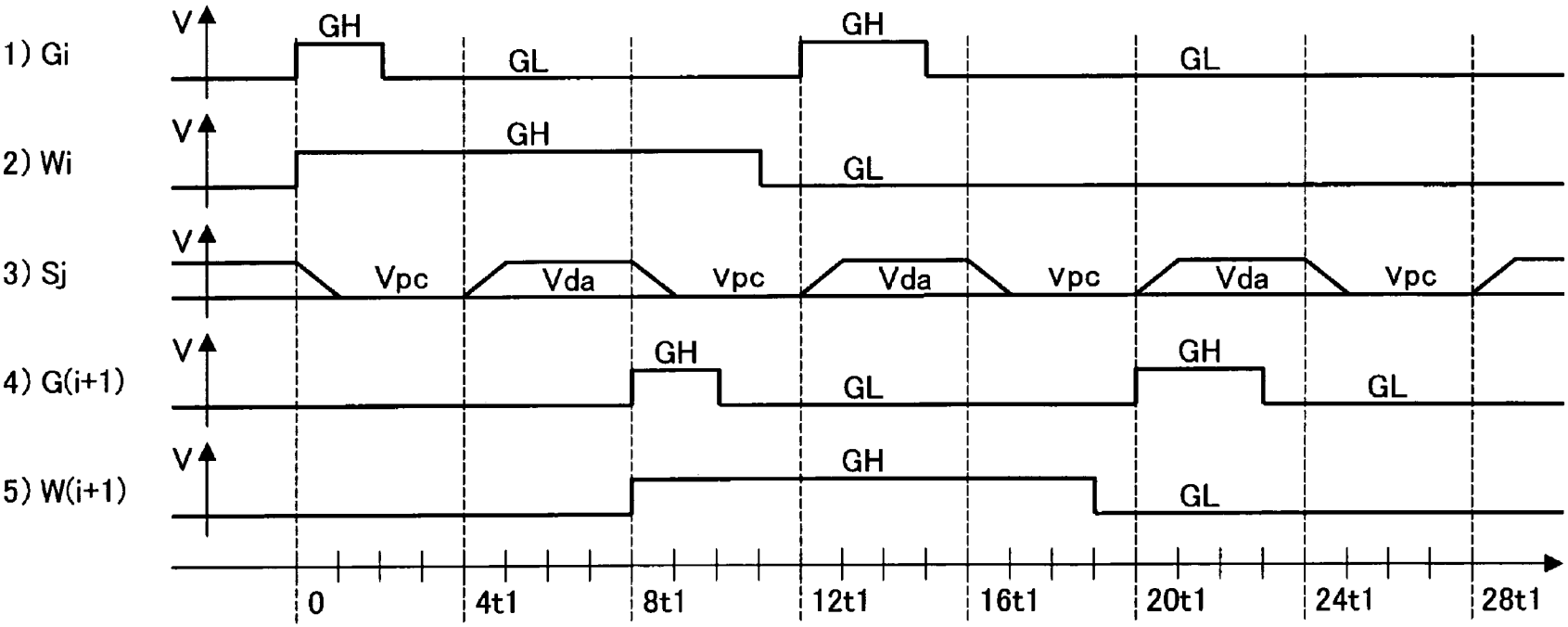
FIG. 13 is a timing chart showing voltages on lines of the pixel circuit illustrated in FIG. 12.

The following will describe the operation of the pixel circuit Aij with reference to a timing chart illustrated in FIG. 13.

FIG. 13 shows timings indicated by voltages on 1) the gate line Gi, 2) the control line Wi, and 3) the source line Sj in the pixel circuit Aij. 4) G(i+1) and 5) W(i+1) are those for a subsequent pixel A(i+1)j.

The present embodiment adopts the second drive method, and a time 0 to 2*t*1 is therefore an initialization period prior to the first period. The first period is a time 2*t*1 to 12*t*1.

During the initialization period, the gate line Gi is set to GH, turning on the switching TFTs Q3 and Q11, setting a voltage of the node B to be the voltage Vb of the voltage line Vb, and feeding an initialization voltage Vpc from the source line Sj. Further, the control line Wi is set to GH, turning on the switching TFT Q12. As a result of this, voltage Va (predetermined voltage) is applied from the voltage line Va to the gate terminal of the driver TFT Q1.

The voltage Vb is set so as to satisfy $$Vb < Va - Vth(\max)$$

where Vth (max) is the worst threshold voltage among threshold variations of the driver TFT Q1). Alternatively, the voltage Vb is set to be lower than Vcom. As a result of this, voltage difference V0 across the capacitor C2 is Vpc−Vb.

The present embodiment assumes that on the assumption that capacitance of the capacitor C2>>capacitance of the capacitor C1, voltage difference across the capacitor C2 does not change so much even when voltage difference across the capacitor C1 significantly changes. That is, it is assumed that the voltage difference across the capacitor C2 set in the "initialization period" is retained during the "first period". In this arrangement, the TFT Q3 is turned on even at the setting of the data voltage Vda. Therefore, it is preferable that Vpc is approximately a voltage of Vda (dark display).

Vpc is in the range of voltage magnitude of Vda. When Vda is 0V to 5V, Vpc should be 0V.

Thereafter, the gate line Gi is set to GL in time 2*t*1 to 11*t*1, turning off the switching TFTs Q3 and Q11, making the control line Wi remained GH, and turning on the switching TFT Q12.

As a result of this, the voltage Va fed from the voltage line Va to the gate terminal of the driver TFT Q1 is maintained.

Then, the source terminal voltage of the driver TFT Q1 increases, and the voltage of the node B gradually changes to Va−Vth. After the change is almost completed, the control line Wi is set to GL, turning off the switching TFT Q12.

In this case, Vth is a sum of the voltage difference retained in the capacitor C1 and the voltage difference retained in the capacitor C2. Assuming that the voltage difference across the capacitor C2 does not change so much on the basis of the assumption that capacitance of the capacitor C2>>capacitance of the capacitor C1, the voltage difference retained in the capacitor C2 is approximately Vpc−Vb, and the voltage difference retained in the capacitor C1 is approximately Vth−(Vpc−Vb).

Especially, if Vpc=Vb, voltage difference Vth is retained in the capacitor C1.

Thereafter, during a second period from time 12*t*1 to 15*t*1, the gate line Gi is set to GH.

This turns on the switching TFTs Q11 and Q3, feeding the voltage Vda of the source line Sj to the node A, and feeding the voltage Vb of the voltage line Vb to the node B.

As a result of this, the voltage stored in the capacitor C2 changes to Vda−Vb, and the gate-to-source voltage of the driver TFT Q1 changes from Vth to Vth+(Vda−Vpc).

Voltage setting of the capacitor C2 requires application of a voltage across the capacitor C2. This is realized by the arrangement in which the gate terminals of the TFTs Q11 and Q3 are coupled to the gate line Gi.

This evidences that with the use of the pixel circuit illustrated in FIG. 12, the value Ids of the current flowing through the driver TFT Q1 is determined by the data voltage Vda and the initialization voltage Vpc, regardless of the threshold Vth.

In the arrangement illustrated in FIG. 12 as in the arrangement illustrated in FIG. 9, a value of Va is almost the same as that of Vcom because a voltage of the node B is Va−Vth. This causes Va−Vth to be lower than Vcom, so that a reverse voltage is applied to the organic EL.

Thus, the use of the means of the present invention eliminates a switching transistor between the driver transistor and the electro-optical element, unlike the example of FIG. 14 in the descriptions of the conventional art. This avoids the increase of power consumption caused by voltage drop in the switching transistor.

Especially, to realize the switching transistor by amorphous silicon, a size of the switching transistor increases. The display device of the present invention eliminates the need for such a switching transistor, thereby enabling a high aperture ratio in the bottom emission structure and a high definition in the top emission structure.

Further, since both of the voltages to be fed to the power supply line and the common electrode are DC voltages, it is possible to directly couple the power supply line and the common electrode to a DC power source, unlike the example of FIG. 15 in the descriptions of the conventional art. This eliminates the need for a switch disposed between the power supply line and the DC power source.

Thus, a substrate made from CG silicon TFT or polysilicon TFT eliminates the need for an external switch. This makes it possible to fabricate the driver circuit from CG silicon or polysilicon TFT, thus enabling cost reduction of the display device.

Further, a substrate made from amorphous silicon TFT eliminates the need for such a switch in a driver IC. Cost reduction of the driver IC leads to cost reduction of the display device.

Still further, it is possible to ensure the compensation for the threshold of the driver transistor, regardless of a select period.

Thus, the use of the means of the present invention evidently brings advantageous effects.

As is the case with other embodiments, the present embodiment may have the arrangement such that the source line is used for the supply of data signal Vda and Vpc is supplied from other line. In this case, it is necessary to provide a TFT between the node A and the line used for Vpc. Conversely, as is the case with the present embodiment, First through Third Embodiments can have the arrangement such that a voltage of the node A is controlled through the source line Sj.

In addition to the above arrangement, the display device according to the present invention is preferably such that the first capacitor and the second capacitor are connected in series in this order between the gate terminal of the driver transistor and the node B, a first switching transistor is provided between the gate terminal of the driver transistor and the first line, and a second switching transistor is provided between a second line and a node A, which is a node of the first capacitor and the second capacitor.

According to the above arrangement, the threshold voltage Vth or a voltage corresponding to the threshold voltage Vth is retained by one of the first capacitor and the second capacitor, and a voltage retained by the other capacitor is changed. This makes it possible to control the gate-to-source voltage Vgs of the driver transistor so that the driver transistor feeds a current of a desired value. As a result of this, a current of a desired value can be flown from the driver transistor to the electro-optical element, regardless of the threshold voltage Vth of the driver transistor. In addition to the effects of the above arrangement, this brings the effect such that a current flowing to the electro-optical element can be controlled with a simple arrangement.

In addition to the above arrangement, the display device according to the present invention is preferably such that during a first period, data voltage as the image signal is applied from the first line to the gate terminal of the driver transistor, and a predetermined auxiliary voltage is applied from the second line to the node A, during a second period following the first period, the predetermined voltage of the node A is retained, and during a third period following the second period, a voltage of the gate terminal of the driver transistor changes to a voltage obtained by addition of the threshold voltage Vth and the data voltage.

According to the above arrangement, during the first period the data voltage Vda as the image signal is applied from the first line to the gate terminal of the driver transistor in the arrangement illustrated in FIG. 1 or FIG. 6, for example. Then, a predetermined auxiliary voltage is applied from the second line to the node A via the second switching transistor throughout the first period and the second period. This fixes a voltage of the other terminal of the first capacitor to the predetermined auxiliary voltage, thus enabling the gate terminal of the driver transistor to retain the data voltage. In addition to the effects of the above arrangement, this brings the effect such that the compensation for the threshold of the driver transistor can be performed throughout the first and second periods, and a current flowing to the electro-optical element can be controlled over a sufficiently long compensation period.

In addition to the above arrangement, the display device according to the present invention is preferably such that during a first period, a predetermined auxiliary voltage is applied to the gate terminal of the driver transistor, and during a second period following the first period, a data voltage as the image signal is applied from the second line to the node A, and a voltage of the gate terminal of the driver transistor changes to a voltage obtained by addition of the threshold voltage Vth and the data voltage.

According to the above arrangement, during the first period the predetermined auxiliary voltage Va is applied from the first line to the gate terminal of the driver transistor in the arrangement illustrated in FIG. 9 or FIG. 12, for example. This allows the voltage of the node B to be Va−Vth at the end of the first period. During the second period, the data voltage Vda as the image signal is applied from the second line to the node A, so that a voltage retained in the second capacitor is changed to a voltage corresponding to the data voltage Vda. This makes it possible to control the gate-to-source voltage Vgs of the driver transistor by using the data voltage Vda fed from the second line. In addition to the effects of the above arrangement, this brings the effect such that the compensation for the threshold of the driver transistor can be performed throughout the first period, and a current flowing to the electro-optical element can be controlled over a sufficiently long compensation period.

In addition to the above arrangement, the display device according to the present invention is preferably such that a third switching transistor is provided between the node B and the third line.

According to the above arrangement, the third switching transistor is turned on in the arrangement illustrated in FIG. 1, 9, or 12, for example, thereby allowing the voltage of the node B to be the voltage Vb of the third line. In addition to the effects of the above arrangement, this brings the effect such that the voltage of the node B can be easily set and a current flowing to the electro-optical element can be controlled with a simple arrangement.

In addition to the above arrangement, the display device according to the present invention is preferably such that a voltage of the second line changes.

According to the above arrangement, the voltage of the second line is changed when the second switching transistor is in the on-state in the arrangement illustrated in FIG. 6, for example, thereby changing the voltage of the node A coupled to the second line. This makes it possible to change the voltage of the node B through the second capacitor. In addition to the effects of the above arrangement, this brings the effect such that a current flowing to the electro-optical element can be controlled with a simple arrangement.

In addition to the above arrangement, the display device according to the present invention is preferably such that a fourth switching transistor is provided in parallel to the first capacitor or the second capacitor.

According to the above arrangement, a voltage difference across the capacitor (first capacitor or second capacitor) which is provided near the fourth switching transistor is once made zero in the arrangement illustrated in FIG. 1, 6, or 9, for example, so that a data voltage as an image signal is applied. This makes it possible to change a voltage of the gate terminal of the driver transistor to a voltage obtained by addition of the data voltage and the threshold voltage Vth. In addition to the effects of the above arrangement, this brings the effect such that a current flowing to the electro-optical element can be controlled with a simple arrangement.

In addition to the above arrangement, the display device according to the present invention is preferably such that the second switching transistor is provided between the node A and the second line, and the third switching transistor is provided between the node B and the third line.

According to the above arrangement, the first switching transistor which is provided between the gate terminal of the driver transistor and the first line is turned off in the arrangement illustrated in FIG. 9 or 12, for example, thereby turning on the second switching transistor which is provided between the node A and the second line and the third switching transistor which is provided between the node B and the third line. As a result of this, the voltage (Vda) of the second line can be applied to the node A, and the voltage (Vb) of the third line can be applied to the node B, so that the voltage difference across the second capacitor can be set to Vda−Vb. Then, by controlling the voltage Vda fed from the second line, it is possible to control the gate-to-source voltage Vgs of the driver transistor. In addition to the effects of the above arrangement, this brings the effect such that a current flowing to electro-optical element can be controlled with a simple arrangement.

As described above, the display device according to the present invention is arranged such that a node B is a node of the driver transistor and the electro-optical element, Vcom is a voltage of a terminal opposite the node B out of two terminals of the electro-optical element, and Vth is a threshold voltage of the driver transistor, and the display device includes: an initialization section that performs initialization in which while Vcom is kept constant, a voltage Vs of the node B is set to be lower than Vcom−Vth if the node B is coupled to an anode of the electro-optical element, and the voltage Vs of the node B is set to be higher than Vcom−Vth if the node B is coupled to a cathode of the electro-optical element; a threshold correcting section that performs threshold correction in which a voltage for threshold correction is applied to a gate of the driver transistor under the condition where the initialization is performed, so that the gate-to-source voltage Vgs of the driver transistor is changed to Vth; and a signal control section that performs signal control in which a voltage for signal control is applied to the gate of the driver transistor under the condition where the threshold correction is performed, so that the gate-to-source voltage Vgs is changed to a value represented by a sum of the threshold voltage Vth and a value of a voltage corresponding to an image signal.

Further, the display device according to the present invention is arranges such that a first capacitor and a second capacitor are connected in series in this order between a gate terminal of the driver transistor and a node B, which is a node of the driver transistor and the electro-optical element, a first switching transistor is provided between the gate terminal of the driver transistor and the first line, and a second switching transistor is provided between a second line and a node A, which is a node of the first capacitor and the second capacitor.

This brings the effect such that the compensation for the threshold of the driver transistor can be performed without changing a voltage of the power supply line, and the need for a switch between the power supply line and the voltage source is eliminated, so that reduction in production cost of the display device can be realized.

Moreover, it is possible to obtain the effect such that the compensation for the threshold of the driver transistor can be ensured regardless of a select period.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to a display device including an electro-optical element such as an organic EL or EP, or the like use.

The invention claimed is:

1. A display device in which a driver transistor and an electro-optical element are directly connected between a power supply line and a common electrode, a first capacitor and a second capacitor are connected in series in this order between a gate terminal of the driver transistor and a node B, a first switching transistor is provided between the gate terminal of the driver transistor and a first line, a second switching transistor is provided between a second line and a node A, which is a node of the first capacitor and the second capacitor, and a current corresponding to an image signal is fed to the electro-optical element so that a corresponding image is displayed thereon, wherein the node B is a node of the driver transistor and the electro-optical element, Vcom is a voltage of a terminal opposite the node B out of two terminals of the electro-optical element, and Vth is a threshold voltage of the driver transistor, the display device comprising:

an initialization section that performs initialization in which while Vcom is kept constant, a voltage Vs of the node B is set to be lower than Vcom if the node B is coupled to an anode of the electro-optical element, and the voltage Vs of the node B is set to be higher than Vcom if the node B is coupled to a cathode of the electro-optical element;

a threshold correcting section that performs threshold correction in which data voltage as the image signal is applied from the first line to the gate terminal of the driver transistor, and a predetermined auxiliary voltage is applied from the second line to the node A under the condition where the initialization is performed, so that the gate-to-source voltage Vgs of the driver transistor is changed to Vth; and a signal control section that performs signal control in which a voltage for signal control is applied to the gate of the driver transistor under the condition where the threshold correction is performed, so that the gate-to-source voltage Vgs is changed to a value represented by a sum of the threshold voltage Vth and a value of a voltage corresponding to an image signal.

2. The display device according to claim 1, wherein a voltage of the second line changes.

3. A display device in which a driver transistor and an electro-optical element are directly connected between a power supply line and a common electrode, and a current corresponding to an image signal is fed to the electro-optical element so that a corresponding image is displayed thereon, wherein a first capacitor and a second capacitor are connected in series in this order between a gate terminal of the driver transistor and a node B, which is a node of the driver transistor and the electro-optical element, a first switching transistor is provided between the gate terminal of the driver transistor and a first line, and a second switching transistor is provided between a second line and a node A, which is a node of the first capacitor and the second capacitor, and a third switching transistor is disposed in parallel to the first capacitor.

4. The display device according to claim 1, wherein during a first period, the data voltage as the image signal is applied from the first line to the gate terminal of the driver transistor, and the predetermined auxiliary voltage is applied from the second line to the node A, during a second period following the first period, the predetermined voltage of the node A is retained, and during a third period following the second period, a voltage of the gate terminal of the driver transistor changes to a voltage obtained by addition of the threshold voltage Vth and the data voltage.

5. The display device according to claim 1, wherein a third switching transistor is provided between the node B and a third line.

6. The display device according to claim 3, wherein a voltage of the second line changes.

7. The display device according to claim 1, wherein a fourth switching transistor is provided in parallel to the first capacitor.

8. The display device according to claim 3, wherein a fourth switching transistor is provided between the node B and a third line.

* * * * *